United States Patent [19]

Fukuda

[11] Patent Number: 4,959,968

[45] Date of Patent: Oct. 2, 1990

[54] METHOD FOR CONTROLLING THE DEFROSTING OF REFRIGERATOR-FREEZER UNITS OF VARYING DEGREES OF FROST ACCUMULATION

[75] Inventor: Toshiyuki Fukuda, Isesaki, Japan

[73] Assignee: Sanden Corporation, Gunma, Japan

[21] Appl. No.: 324,707

[22] Filed: Mar. 17, 1989

[30] Foreign Application Priority Data

| | | | |
|---|---|---|---|
| Mar. 17, 1988 | [JP] | Japan | 63-64628 |
| Mar. 17, 1988 | [JP] | Japan | 63-64629 |
| Mar. 17, 1988 | [JP] | Japan | 63-64630 |
| Mar. 17, 1988 | [JP] | Japan | 63-64632 |
| Mar. 17, 1988 | [JP] | Japan | 63-64633 |
| Mar. 17, 1988 | [JP] | Japan | 63-64634 |

[51] Int. Cl.[5] ..... F25D 21/08

[52] U.S. Cl. ..... 62/155; 62/156; 62/200; 62/234; 62/276

[58] Field of Search ..... 62/155, 156, 151, 152, 62/234, 276, 275, 199, 200, 205, 203, 204, 80, 117; 165/17

[56] References Cited

U.S. PATENT DOCUMENTS

| | | | |
|---|---|---|---|
| 3,147,602 | 9/1964 | Beckwith | 62/278 |
| 3,464,226 | 9/1969 | Kramer | 62/196 |
| 3,499,295 | 3/1970 | Brennan | 62/81 |
| 3,638,444 | 2/1972 | Lindahl | 62/81 |
| 4,084,388 | 4/1978 | Nelson | 62/152 |
| 4,122,686 | 10/1978 | Lindahl et al. | 62/81 |
| 4,197,716 | 4/1980 | Nussbaum | 62/196 |
| 4,411,139 | 10/1983 | Bos | 62/155 X |
| 4,510,767 | 4/1985 | Komatsu et al. | 62/200 |
| 4,644,758 | 2/1987 | Maehara et al. | 62/234 |
| 4,741,171 | 5/1988 | Toshiyuki | 62/234 |

FOREIGN PATENT DOCUMENTS

| | | |
|---|---|---|
| 1038536 | 5/1964 | United Kingdom . |
| 1259852 | 5/1969 | United Kingdom . |
| 1588790 | 5/1978 | United Kingdom . |

*Primary Examiner*—Harry B. Tanner

*Attorney, Agent, or Firm*—Banner, Birch, McKie & Beckett

[57] ABSTRACT

A method for controlling the defrosting of evaporators provided for refrigerator-freezer units which are cooled by a single compressor. The method includes the steps of forcedly resetting the defrosting timer to its cooling mode after entering defrosting mode after the defrosting of a preset number of evaporators. The remaining undefrosted evaporators are warmed by their remaining heat after the forced resetting, by supplying electric current to their defrosting heaters sooner than the already defrosted evaporators in the next defrosting, by supplying additional electric current to their defrosting heaters after the forced resetting, by accomplishing a complete defrosting in an unsalable mode, by using outside air for defrosting by stopping their outer fans or by additional heating via auxiliary defrosting heaters. The defrosting of all of the evaporators can be performed sufficiently and uniformly, excessive warming of the inside of any unit can be prevented, and the cooling loads after a defrosting mode can be prevented from increasing too much.

2 Claims, 23 Drawing Sheets

3
(204)
SA ON
NO
YES
HA OFF
(205)
(208)
COOLING MODE
YES
NO
n→n+1
(206)
(207)
n=2
YES
NO
(209)
SB ON
NO
YES
HB OFF
(210)
(213)
COOLING MODE
YES
NO
n→n+1
(211)
(212)
n=2
YES
NO
(214)
SC ON
NO
YES
HC OFF
(215)
(218)
COOLING MODE
YES
NO
n→n+1
(216)
(217)
n=2
YES
NO
2
(219)
MEMORIZE EVAPORATOR
→ COOLING MODE
(220)
2
REST HEATER OFF
10A, 10B, 10C OPEN
COMPRESSOR ON
(221)
1

METHOD FOR CONTROLLING THE DEFROSTING OF REFRIGERATOR-FREEZER UNITS OF VARYING DEGREES OF FROST ACCUMULATION

BACKGROUND OF THE INVENTION

1. Field of the Invention

The present invention relates to a method for controlling the defrosting of a plurality of refrigerator-freezer units of varying degrees of frost accumulation cooled by a single compressor/condenser.

2. Description of the Prior Art

A cooling system wherein a plurality of refrigerator-freezer units of varying degrees of frost accumulation are cooled by use of a single compressor/condenser is known. The refrigerator-freezer units, for example, may comprise showcases for display of refrigerated or frozen foods. The respective showcases have respective evaporators for cooling the showcases. The respective evaporators are connected to a single condenser and a single compressor via respective expansion valves and solenoid valves. Defrosting heaters for defrosting a frost accumulated on the evaporators are provided on respective evaporators. When the evaporators are defrosted, all of the solenoid valves are closed, the drive of the compressor is stopped and electric current is supplied to all of the defrosting heaters to defrost the frost on the evaporators The conventional control method for defrosting the evaporators is shown in FIG. 21. FIG. 21 illustrates a time chart in the case where three showcases are cooled by a single compressor. The time between periods of defrosting and the period of time for defrosting of the evaporators of the showcases are preset by a defrosting timer, for example, the time for beginning the defrosting is preset to an eight hour interval and the period of time for defrosting is preset to twenty minutes. When the defrosting timer switches operation to a defrosting mode, all of the solenoid valves are closed and the drive of the compressor is stopped which stops the cooling of the evaporators. At the same time, electric current is supplied to all of the defrosting heaters Ha, Hb and Hc, and the heaters warm the evaporators to dissolve and eliminate frost accumulated on the evaporators. The period of time of supplying electric current is the same (for example, twenty minutes) for all of the defrosting heaters as predetermined by the defrosting timer operation. This period of time is usually set to a sufficient time for defrosting that evaporator on which the amount of accumulated frost is the largest. Then, when the defrosting timer returns operation from the defrosting mode to its cooling mode, the compressor is again driven, all of the solenoid valves are opened and the cooling medium is circulated to all of the evaporators, thereby beginning the cooling of the showcases In such a conventional control method, since electric current is supplied to the defrosting heaters while the compressor is stopped, the power source for the heaters and the power source for the compressor can be shared by switching the common power source from the compressor to the heaters. Therefore, the total capacity of the power source required for the entire showcase apparatus can be small in comparison with a situation where independent power sources are provided for the heaters and the compressor.

In the conventional defrosting control method, such as the one described above, however, since the period of time for supplying electric current to the defrosting heaters is set for that evaporator which requires the longest time for defrosting, the temperatures a and b inside of the showcases which have different evaporators increases to a level well above temperature c inside of the showcase having the evaporator requiring the longest defrosting period and becomes much higher than a temperature level necessary for completing the defrosting of the evaporators, as shown in FIG. 21. Accordingly, the goods contained in the showcases are unneccessarily warmed, thereby reducing the quality of any goods stored in those showcases. Moreover, the rise of the temperatures inside of the showcases causes the cooling loads of the showcases to increase when the cooling of the showcases begins after the defrosting, thereby greatly decreasing the cooling efficiencies of the showcases.

It is possible to shorten the period for defrosting in order to avoid these problems. However, if the defrosting time is shortened, some accumulated frost may remain on, for example, evaporator c. The remaining frost obstructs the cooling action of those evaporators, and any goods contained in the showcases may not be sufficiently cooled.

On the other hand, another system of showcases is known which has outer fans for forming air flow curtains which prevent outside air from entering the showcases. Alternatively, outside air may be conducted to the positions of evaporators when the drive of the outer fans stops. In this system as shown in FIG. 22, the drive of all of the outer fans Fa, Fb and Fc is stopped at the same time as electric current supply to the defrosting heaters Ha, Hb and Hc when a defrosting timer switches operation to its defrosting mode. Outside air is led to the positions of the evaporators by stopping the outer fans, the temperature of the air defrosts the evaporators, and the time for defrosting can be shortened in comparison with the situation where only the heaters are used during the defrosting mode.

Also in this control method, however, since the period of time for supplying electric current to the defrosting heaters is set for that evaporator which requires the longest time for defrosting, the temperatures a and b inside of the showcases which have different evaporators increases to a level well above temperature c inside of the showcase with the longest defrosting period. Therefore, the same problems as those aforementioned still remain.

SUMMARY OF THE INVENTION

Accordingly, an object of the present invention is to provide a method for controlling the defrosting of refrigerator-freezer units which prevents unnecessary increases in temperature and can effectively dissolve and eliminate frost accumulated on evaporators of the units.

To achieve this object, the following control methods are provided according to the present invention.

A first method for controlling the defrosting of a plurality of refrigerator-freezer units, according to the present invention, provides for successive actuation of defrosting heaters. The respective showcases have respective evaporators and respective defrosting heaters for defrosting the frost on the evaporators. The respective evaporators are connected to a single condenser and compressor via respective expansion valves and solenoid valves. The method comprises the steps of: closing all of the solenoid valves, stopping the drive of the compressor and supplying electric current to all of the defrosting heaters when a defrosting timer switches to its defrosting mode. However, according to the present invention, the supply of electric current to each defrosting heater of a number of defrosting heaters is successively terminated when a corresponding sensor associated with each unit detects the defrosting of a corresponding evaporator. Once, the defrosting of a preset number of evaporators is detected the defrosting timer is then returned to its cooling mode. Supply of electric current to the rest of the defrosting heaters is terminated. The drive of the compressor is reactuated and the solenoid valves connected to defrosted evaporators are opened. The solenoid valves for the rest of the evaporators are opened before or after expiration of a preset period of time since the beginning of defrosting.

A second control method according to the present invention comprises the steps of: closing all of solenoid valves, stopping the drive of a compressor and supplying electric current to all of defrosting heaters when a defrosting timer switches to its defrosting mode. However, according to this method supply of electric current to a defrosting heater of the defrosting heaters is successively terminated when a corresponding sensor provided for each unit detects the finish of the defrosting of its corresponding evaporator and further comprises the steps of forcedly resetting the defrosting timer to its cooling mode, stopping the supply of electric current to the rest of the defrosting heaters, beginning the drive of the compressor and opening all of the solenoid valves. As a result there may remain one or more evaporators which are not completely defrosted. In the next defrosting mode, the method comprises the steps of closing all of solenoid valves, stopping the drive of the compressor and supplying electric current to the remaining undefrosted heaters when the defrosting timer switches to its defrosting mode, and then after a preset time from the beginning of the defrosting mode expires, supplying electric current to the defrosting heaters for the preset number of defrosted evaporators in the last defrosting mode.

A third control method according to the present invention comprises the steps of: closing all of solenoid valves, stopping the drive of a compressor and supplying electric current to all of defrosting heaters when a defrosting timer switches to its defrosting mode; successively stopping the supply of electric current to a defrosting heater of the defrosting heaters when a corresponding sensor provided to each unit detects the defrosting of a corresponding evaporator; beginning the drive of the compressor and opening the solenoid valves connected to the defrosted evaporators after defrosting a preset number of evaporators among all of the evaporaters; stopping the supply of electric current to a defrosting heater of the rest of the defrosting heaters and successively opening a corresponding solenoid valve after the defrosting of a corresponding evaporator; and stopping the supply of electric current to all of the rest of the defrosting heaters and opening all of the rest of the solenoid valves after a preset time from the beginning of the defrosting mode.

A fourth control method according to the present invention comprises the steps of: closing all of solenoid valves, stopping the drive of a compressor and supplying electric current to all of defrosting heaters after a defrosting timer switches to its defrosting mode; detecting the defrosting of each evaporator by a sensor provided for each unit; switching units between a salable mode and an unsalable mode; in the salable mode and after switching to the defrosting mode, successively stopping the supply of electric current to a defrosting heater of the defrosting heaters after the corresponding sensor detects the defrosting of the corresponding evaporator, thereafter stopping the supply of electric current to the rest of the defrosting heaters, beginning the drive of the compressor and opening all of the solenoid valves after the defrosting of a preset number of evaporators; and in the unsalable mode and after switching to the defrosting mode, successively stopping the supply of electric current to a defrosting heater of the defrosting heaters after the corresponding sensor detects the defrosting of the corresponding evaporator, thereafter stopping the supply of electric current to the rest of defrosting heaters if there are any undefrosted evaporators, beginning the drive of the compressor and opening all of the solenoid valves after a preset time sufficient for the defrosting of substantially all of the evaporators expires.

In a fifth control method according to the present invention, a plurality of units additionally have respective outer fans capable of making air flow curtains for preventing outside air from entering into the units and drawing outside air to positions of respective evaporators after the drive of the outer fans stops. The method comprises the steps of: closing all of solenoid valves, stopping the drive of a compressor, supplying electric current to all of defrosting heaters and stopping the drive of specific outer fans after a defrosting timer switches to its defrosting mode, the specific outer fans being ones which are provided to the units having the undefrosted evaporators in the last defrosting mode, the defrosting of each evaporator being detected by a sensor provided for each unit; successively stopping the supply of electric current to a defrosting heater of the defrosting heaters after the corresponding sensor detects the defrosting of the corresponding evaporator; forcedly resetting the defrosting timer to its cooling mode, stopping the supply of electric current to the rest of the defrosting heaters, beginning the drive of the compressor, opening all of the solenoid valves and beginning the drive of the stopped specific outer fans, after defrosting a preset number of evaporators among all of the evaporators.

A sixth control method according to the present invention comprises the steps of: closing all of solenoid valves, stopping the drive of a compressor and supplying electric current to all defrosting heaters and specific auxiliary defrosting heaters among auxiliary defrosting heaters provided on respective evaporators after a defrosting timer switches to its defrosting mode, the specific auxiliary defrosting heaters being ones which are provided on the undefrosted evaporators in the last defrosting mode, the defrosting of each evaporator being detected by a sensor provided for each unit; successively stopping the supply of electric current to a defrosting heater and an auxiliary defrosting heater of the defrosting heaters and the auxiliary defrosting heaters after the corresponding sensor detects the defrosting of the corresponding evaporator; forcedly resetting the defrosting timer to its cooling mode, stopping the supply of electric current to the rest of the defrosting heaters and the auxiliary defrosting heaters, beginning the drive of the compressor and opening all of the solenoid valves, after the defrosting of a preset number of evaporators among all of the evaporators.

In the above-described first control method, after defrosting the preset number of evaporators and before the preset defrosting period expires, the solenoid valves for the evaporators other than the defrosted evaporators are not opened. Therefore, cooling medium is not supplied to these evaporators during this time, and the frost remaining on the evaporators can be dissolved and eliminated by the remaining heat and the outside air temperature. Since the cooling of the preset number of evaporators has begun and the evaporators which require relatively long times for defrosting are defrosted by the remaining heat and the outside air circulation and are not cooled until after the preset time period for defrosting lapses, a certain evaporator can be prevented from being warmed too much and from being insufficiently defrosted. In fact, all of the evaporators are sufficiently and uniformly defrosted. The insides of the units and any goods contained therein are not unnecessarily warmed, and the frost of each evaporator can be sufficiently eliminated. As a result, a reduction of the quality of the contained goods and an increase in the cooling loads of the units when the cooling mode restarts can be prevented. The units with sufficiently defrosted evaporators can be efficiently cooled after this defrosting control method is completed In the above second control method, the supply of electric current to remaining undefrosted evaporators from the last defrosting mode, is begun earlier by the preset time than the supply of electric current to the preset number of defrosted evaporators from the last defrosting mode. The frost on the above evaporators other than the preset number of evaporators can be dissolved earlier than the frost on the preset number of evaporators, by the earlier heating, and the frost on the evaporators including the frost remaining from the last defrosting mode can be sufficiently eliminated. As a result, sufficient and uniform defrosting of all of the evaporators is achieved after the second defrosting mode. Also in this second control method, the quality of the contained goods is preserved and the cooling loads of the units reduced so as to efficiently cool the units by this defrosting control method.

In the above third control method, the supply of electric current to the defrosting heaters for the preset number of evaporators is stopped after the defrosting of the preset number of evaporators, and then cooling of the preset number of evaporators begins. Even after that, the supply of electric current to the defrosting heaters for the evaporators other than the preset number of evaporators, namely for the undefrosted evaporators is continued until after the defrosting of each of the evaporators is finished or after the preset time expires. Therefore, the rest of evaporators other than the preset number of evaporators are positively and sufficiently warmed by the defrosting heaters, and the frost on substantially all of the evaporators can be dissolved and eliminated, while the preset number of evaporators have been cooled in advance. As a result, the defrosting of substantially all of the evaporators can be completed in every cycle of defrosting control. Also in this third control method, the quality of the contained goods is preserved and the cooling loads of the units is reduced so as to efficiently cool the units by this defrosting control method.

In the above fourth control method, the cooling control system for the units is switched between the salable mode and the unsalable mode. In the salable mode, the supply of electric current to all of the defrosting heaters is stopped and the cooling of all of the evaporators is begun after the defrosting of the preset number of evaporators. As the preset number of evaporators are completely defrosted and the cooling of the evaporators starts immediately after their defrosting, the temperature and the cooling conditions inside of the units equipped with these evaporators can be maintained. Also in this method, the quality of the contained goods is preserved and the cooling loads of units caused by an excessive temperature rise inside of the units are reduced.

In the unsalable mode, a sufficiently long time for the defrosting mode is taken, and substantially all of the evaporators are completely defrosted. Therefore, if the frost remains on certain evaporators in the salable mode, the frost will be completely eliminated in the unsalable mode, for example, at night time. As a result, a large amount of frost can be prevented from remaining on the evaporators for a long time, thereby adequately ensuring the cooling action of the evaporators.

In the above fifth control method, outside air can be led to the position of each evaporator after the drive of each outer fan is stopped, and the entering outside air can serve to warm the evaporator. In the current defrosting mode, only the drive of the specific outer fans, which are provided to the units having the undefrosted evaporators from the last defrosting mode, are stopped, and these evaporators can be warmed by the outside air as well as by the defrosting heaters, more rapidly and more strongly than the other evaporators. Therefore, the frost on these evaporators including frost remaining from the last defrosting mode can be sufficiently dissolved and eliminated. Also in this fifth control method, the quality of the contained goods is preserved and the cooling loads of the units is reduced so as to efficiently cool the units by this defrosting control method.

In the above sixth control method, auxiliary defrosting heaters in addition to defrosting heaters are provided to respective evaporators. In the current defrosting mode, electric current is supplied to all of the defrosting heaters and only the specific auxiliary defrosting heaters which are provided for undefrosted evaporators from the last defrosting mode. Therefore, these evaporators are warmed by both the defrosting heaters and the auxiliary defrosting heaters, and can be defrosted more strongly than other evaporators. The frost on these evaporators including the frost remaining from the last defrosting mode can be sufficiently dissolved and eliminated. Also in this sixth control method, the quality of the contained goods is preserved and the cooling loads of the units is reduced so as to efficiently cool the units by this defrosting control method.

BRIEF DESCRIPTION OF THE DRAWINGS

Preferred exemplary embodiments of the invention will now be described with reference to the accompanying drawings which are given by way of example only, and thus are not intended to limit the present invention.

DETAILED DESCRIPTION OF PREFERRED EMBODIMENTS OF THE PRESENT INVENTION

Figure 1:
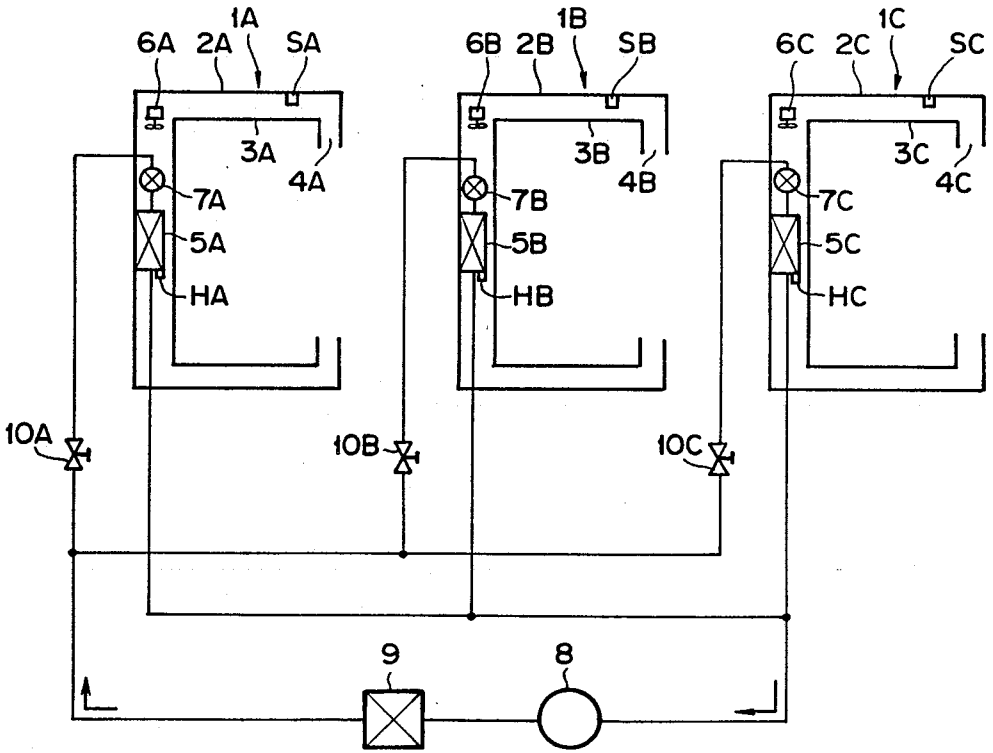
FIG. 1 is a schematic view illustrating a cooling system used for a method according to a first embodiment of the present invention.

Referring to the drawings, FIGS. 1–4 illustrate a method according to a first embodiment of the present invention and a cooling system used for the method. In FIG. 1, refrigerator-freezer units 1A, 1B and 1C, which, for example, may be showcases for refrigerated or frozen foods, are constructed of inner boxes 3A, 3B and 3C and outer boxes 2A, 2B and 2C, respectively. Portions 4A, 4B and 4C between respective inner boxes 3A, 3B and 3C and outer boxes 2A, 2B and 2C are formed as air paths, and evaporators 5A, 5B and 5C and fans 6A, 6B and 6C are provided in the air paths, respectively. Inlet sides of respective evaporators 5A, 5B and 5C are connected to respective expansion valves 7A, 7B and 7C. Expansion valves 7A, 7B and 7C are connected to one condenser 9 and one compressor 8 via respective solenoid valves 10A, 10B and 10C. The outlet sides of evaporators 5A, 5B and 5C are connected to the inlet side of compressor 8. A cooling medium (not shown) is circulated in this closed cooling circuit constructed of compressor 8, condenser 9, solenoid valves 10A, 10B and 10C, expansion valves 7A, 7B and 7C and evaporators 5A, 5B and 5C for cooling the insides of units 1A, 1B and 1C.

Defrosting heaters HA, HB and HC are attached to evaporators 5A, 5B and 5C, respectively, for defrosting the frost on the evaporators. Sensors SA, SB and SC capable of detecting the defrosting of the evaporators, are provided in air paths 4A, 4B and 4C, respectively. The sensors, for example, may be thermostats for air temperature measurement.

In this cooling system, three units 1A, 1B and 1C can be cooled by use of one compressor 8 and one condenser 9, and the cooling can be controlled by the control of solenoid valves 10A, 10B and 10C to open and closed positions.

The above-described apparatus of FIG. 1 is exemplary only. Values for capacities of various elements of FIG. 1 will vary from system to system and, accordingly, the appropriate interval between defrosting periods and the duration of defrosting will vary as well.

Figure 2:
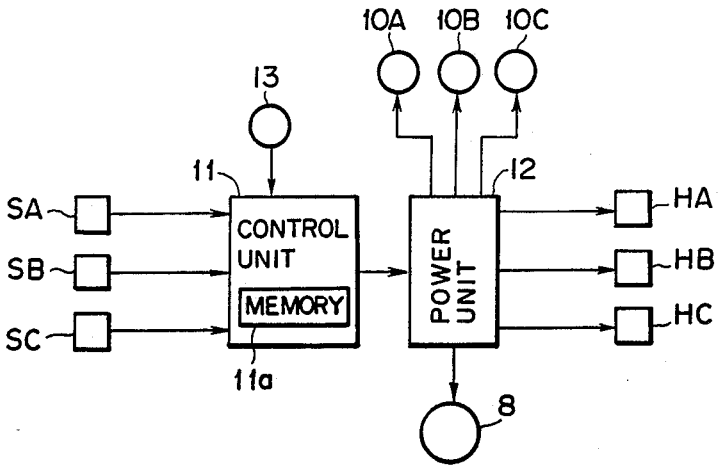
FIG. 2 is a diagram schematically illustrating an electric circuit of the cooling system of FIG. 1.

FIG. 2 schematically illustrates an electric circuit of the cooling system. The signals from sensors SA, SB and SC are sent to a control unit 11 comprising, for example, a microprocessor and a memory 11*a* for storing a defrosting program and data such as counts and times as explained herein. The control signals processed in the control unit are sent from the control unit to a power unit 12. Power unit 12 is connected to compressor 8, solenoid valves 10A, 10B and 10C and defrosting heaters HA, HB and HC, and can supply electric current to each of them. In this embodiment, switching means 13 for switching the units between a salable mode and an unsalable mode is provided and connected to control unit 11. The switching means 13 comprises, for example, a sensor for detecting "on-off" states of the illumination of the units or a manual switch. For example, if the units comprise showcases for frozen food display, the removal of illumination may indicate periods when contained frozen foods are not on display for sale.

Figure 3A:
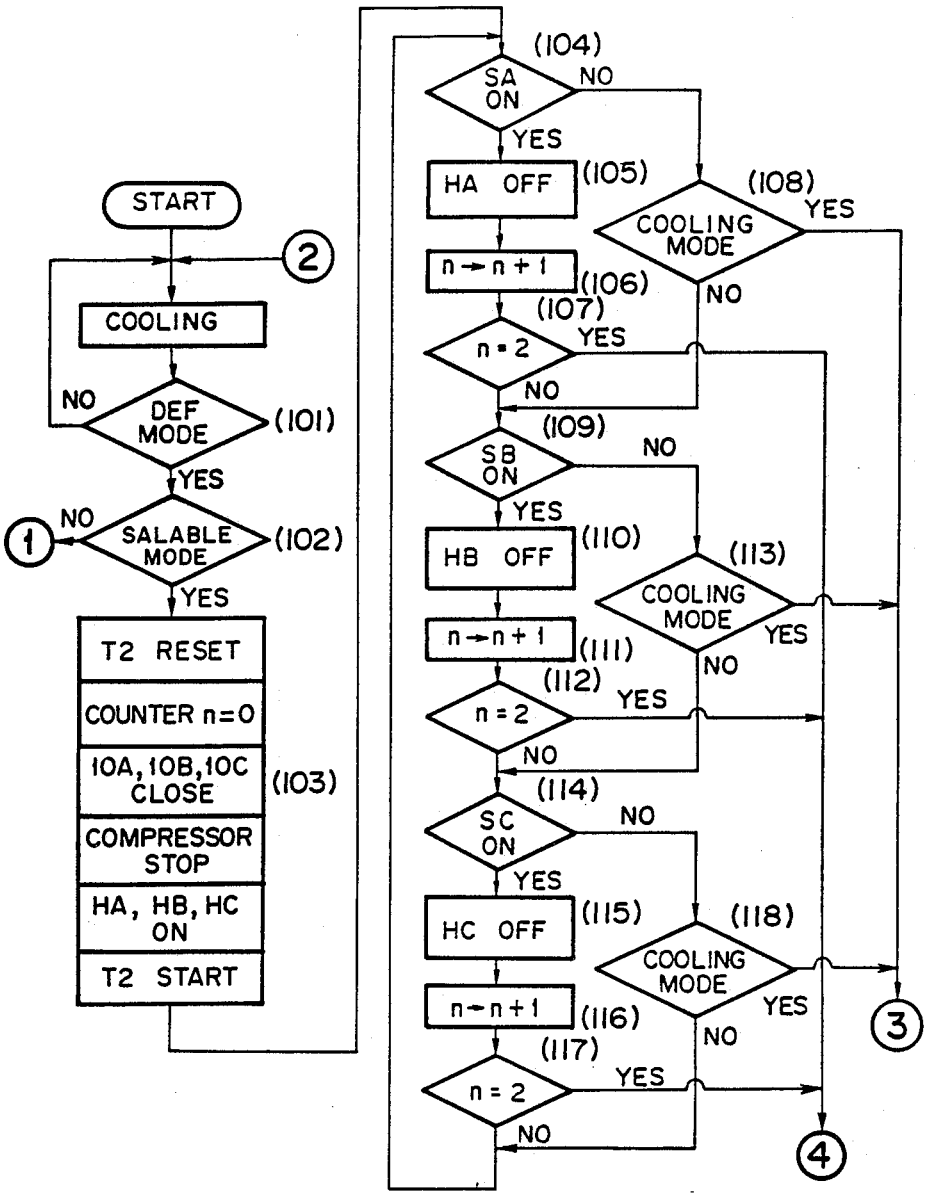
FIGS. 3A and 3B are flowcharts of a control unit assembled in the electric circuit of FIG. 2, showing details of a first defrosting method according to the present invention.
Figure 3B:
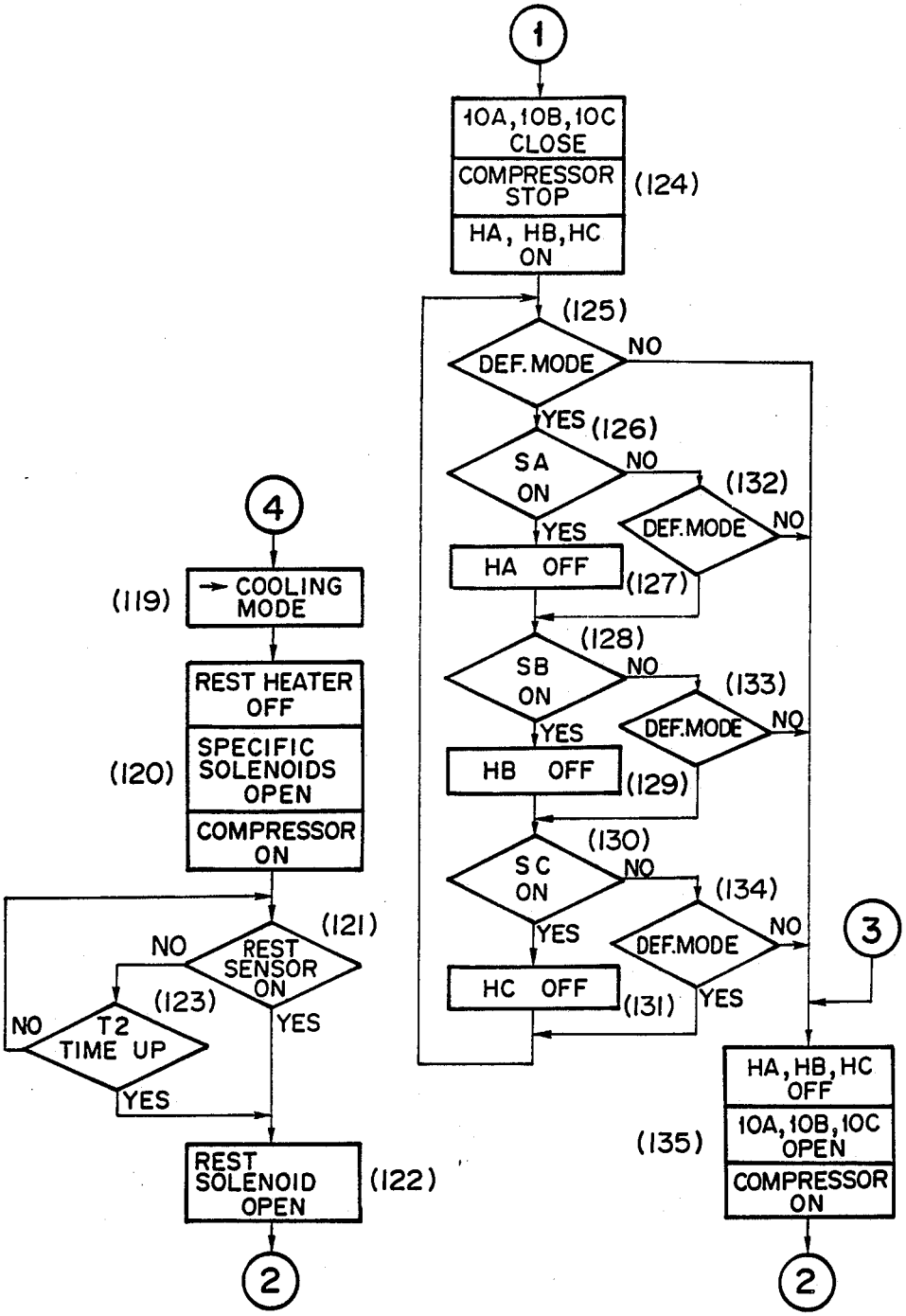
Figure 4:
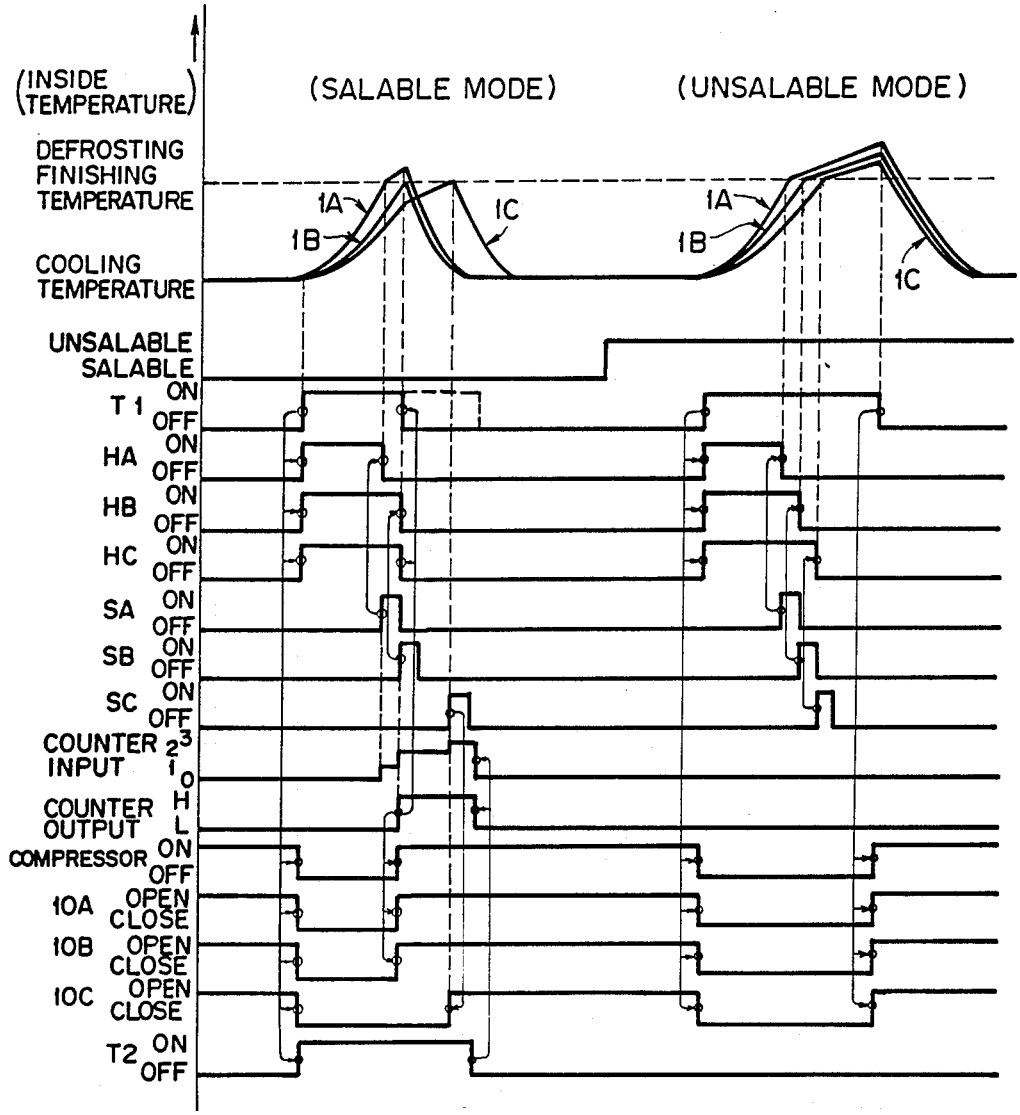
FIG. 4 is a time chart showing defrosting according to the method of FIGS. 3A and 3B.

FIGS. 3A and 3B show a flow chart for controlling the defrosting of the evaporators and FIG. 4 shows a time chart of the control method of this embodiment.

The time period between defrosting periods and the period of time for defrosting are preset by a defrosting timer T1. The defrosting is performed when defrosting timer T1 switches to its defrosting mode, i.e. "on" position. It is first determined during the cooling mode of defrosting timer T1 (T1 OFF) whether the defrosting timer has switched to the defrosting mode (T1 ON) (step 101). In the defrosting mode, it is judged whether the showcases are in the salable mode or not (step 102).

If the present mode is determined to be the salable mode at step 102, a timer T2 for clocking of predetermined period of time for defrosting and a counter (of control unit memory) for counting a number of defrosted units are reset. All of solenoid valves 10A, 10B and 10C are closed and the drive of compressor 8 is stopped. At the same time, electric current is supplied to all of defrosting heaters HA, HB and HC, and timer T2 starts (step 103).

At step 104, it is determined whether sensor SA has detected the defrosting of evaporator 5A. When sensor SA detects the completion of defrosting of evaporator 5A, the supply of electric current to defrosting heater HA is stopped (step 105), 1 count is added to the counter (step 106), and it is determined whether the number stored in the counter is equal to a preset number (in this embodiment, this number is 2) (step 107). If sensor SA has not detected the completion of defrosting evaporator 5A, it is determined whether the current mode is the cooling mode (T1 ON or OFF) (step 108).

Successively, it is determined whether sensor SB has detected the defrosting of evaporator 5B (step 109). When sensor SB detects the defrosting of evaporator 5B, the supply of electric current to defrosting heater HB is stopped (step 110), 1 count is added to the counter (step 111), and it is determined whether the number stored in the counter equals 2 (step 112). If sensor SB has not detected the defrosting of evaporator 5B, it is determined whether the current mode is the cooling mode (step 113).

Then, it is determined whether sensor SC has detected the defrosting of evaporator 5C (step 114). When sensor SC detects the defrosting of evaporator 5C, the supply of electric current to defrosting heater HC is stopped (step 115), 1 count is added to the counter (step 116), and it is determined whether the number stored in the counter is equal to 2 (step 117). If sensor SC has not detected the defrosting of evaporator 5C, it is determined whether the current mode is the cooling mode (step 118).

In the event the counter has not counted to the number of 2 yet in step 117, the flow returns to step 104 and the detection of defrosting of evaporators continues via sensors SA, SB and SC. If the current mode is not determined to be the cooling mode in each of steps 108, 113 and 118, flow proceeds to step 109, 114 or 104, but when the current mode is determined to be the cooling mode, flow proceeds to step 135 as described later.

When the number stored in the counter equals 2 at step 107, 112 or 117, in this embodiment as shown in FIG. 4, for example, when sensors SA and SB detect the defrosting of evaporators 5A and 5B, defrosting timer T1 is forcedly reset to the cooling mode (step 119). The supply of electric current to the rest of the defrosting heaters, i.e. defrosting heater HC, is stopped, only solenoid valves 10A and 10B, which are connected to defrosted evaporators 5A and 5B, are opened, and the drive of compressor 8 is started (step 120). The cooling medium is circulated through evaporators 5A and 5B, and the insides of units 1A and 1B are cooled.

After that, it is determined whether sensor SC, which is the remaining sensor (or sensors), detects the defrosting of evaporator 5C (step 121). When sensor SC detects the defrosting of evaporator 5C, solenoid valve 10C, which is the remaining solenoid valve, is opened (step 122), the cooling medium is circulated again through evaporator 5C and the inside of unit 1C is cooled. Flow now returns to step 1. Even in the case where sensor SC does not detect the defrosting of evaporator 5C, solenoid valve 10C is opened after the expiration of the preset time from the beginning of the defrosting mode, namely, when timer T2 lapses (step 123). If the preset time has not expired, flow returns to step 121.

Thus, defrosting in the salable mode such as during daytime or store hours is controlled. Since electric current is supplied to all of defrosting heaters HA, HB and HC and the preset number of defrosted evaporators 5A and 5B, i.e. two, begin a cooling mode earlier than evaporator 5C which may not be defrosted yet, the evaporators 5A and 5B can be returned to cooling as early as possible and the inside temperature of units 1A and 1B can be prevented from rising excessively (FIG. 4). Evaporator 5C can be adequately warmed and defrosted by the remaining heat and the atmosphere temperature before the sensor SC detects the defrosting of evaporator 5C or prior to the expiration of the preset time of timer T2 whichever occurs sooner. Therefore, the inside temperatures of units 1A, 1B and 1C are maintained near the defrosting finishing temperature at which each sensor detects defrosting (FIG. 4). The defrosting of all evaporators 5A, 5B and 5C can be performed sufficiently and the cooling loads of units 1A, 1B and 1C can be prevented from increasing too much.

When the present mode is determined to be the unsalable mode in step 102 (FIG. 3A) (for example, when the store is closed), all of the solenoid valves 10A, 10B and 10C are closed, the drive of compressor 8 is stopped and electric current is supplied to all defrosting heaters HA, HB and HC at the same time at step 124 (FIG. 3B).

Successively, it is determined whether the current mode is the defrosting mode (T1 is ON or OFF) (step 125). If the current mode is the defrosting mode, it is determined whether sensor SA has detected the defrosting of evaporator 5A (step 126). When sensor SA detects the defrosting of evaporator 5A, the supply of electric current to defrosting heater HA is stopped (step 127), and if evaporator 5A is not defrosted yet, it is determined whether the current mode is the defrosting mode (step 132).

Then, it is determined whether sensor SB has detected the defrosting of evaporator 5B (step 128). If sensor SB has detected the defrosting of evaporator 5B, the supply of electric current to defrosting heater HB is stopped (step 129). If evaporator 5B is not defrosted yet, it is determined whether the current mode is the defrosting mode (step 133).

Further, it is determined whether sensor SC has detected the defrosting of evaporator 5C (step 130). If sensor SC has detected the defrosting of evaporator 5C, the supply of electric current to defrosting heater HC is stopped (step 131). If evaporator 5C is not defrosted yet, it is determined whether the current mode is the defrosting mode (step 134).

If the current mode is determined to be the cooling mode in any one of steps 125, 132, 133 and 134, supply of electric current to all of defrosting heaters HA, HB and HC is stopped, all of solenoid valves 10A, 10B and 10C are opened and the drive of compressor 8 is begun (step 135). The cooling of all units 1A, 1B and 1C starts. Flow then returns to step 1.

Thus defrosting in the unsalable mode such as at night time (or when the store is closed) is controlled. In the unsalable mode the defrosting is continued until all evaporators are completely defrosted, and frost on all of the evaporators is completely eliminated. Heating of evaporators is successively terminated as sensors detect a defrosting temperature and cooling restarts after timer T1 expires.

Figure 5:
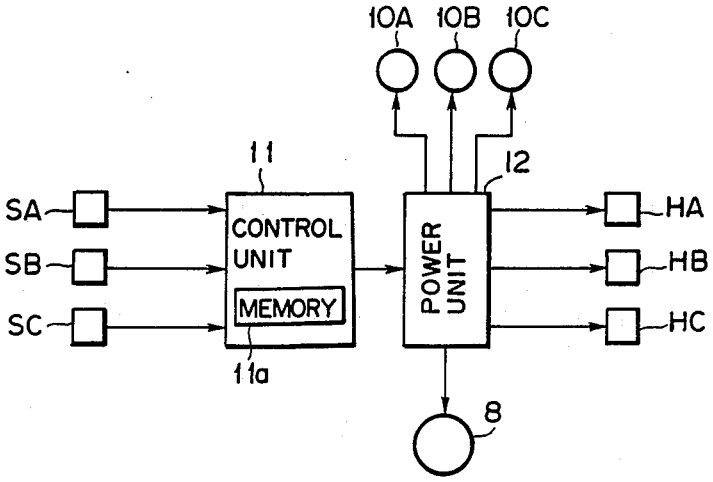
FIG. 5 is a diagram schematically illustrating an electric circuit of a cooling system used for a method according to a second embodiment of the present invention.

FIGS. 5, 6A, 6B and 7 show a second embodiment of the present invention. Identical reference numerals denote similar elements. In FIG. 5, a switching means 13 for switching units between a salable mode and an unsalable mode is not provided in this embodiment. The arrangement and structure of equipment other than the above switching means and the control system program of control unit 11 are substantially the same as in the first embodiment shown in FIG. 1.

Figure 6A:
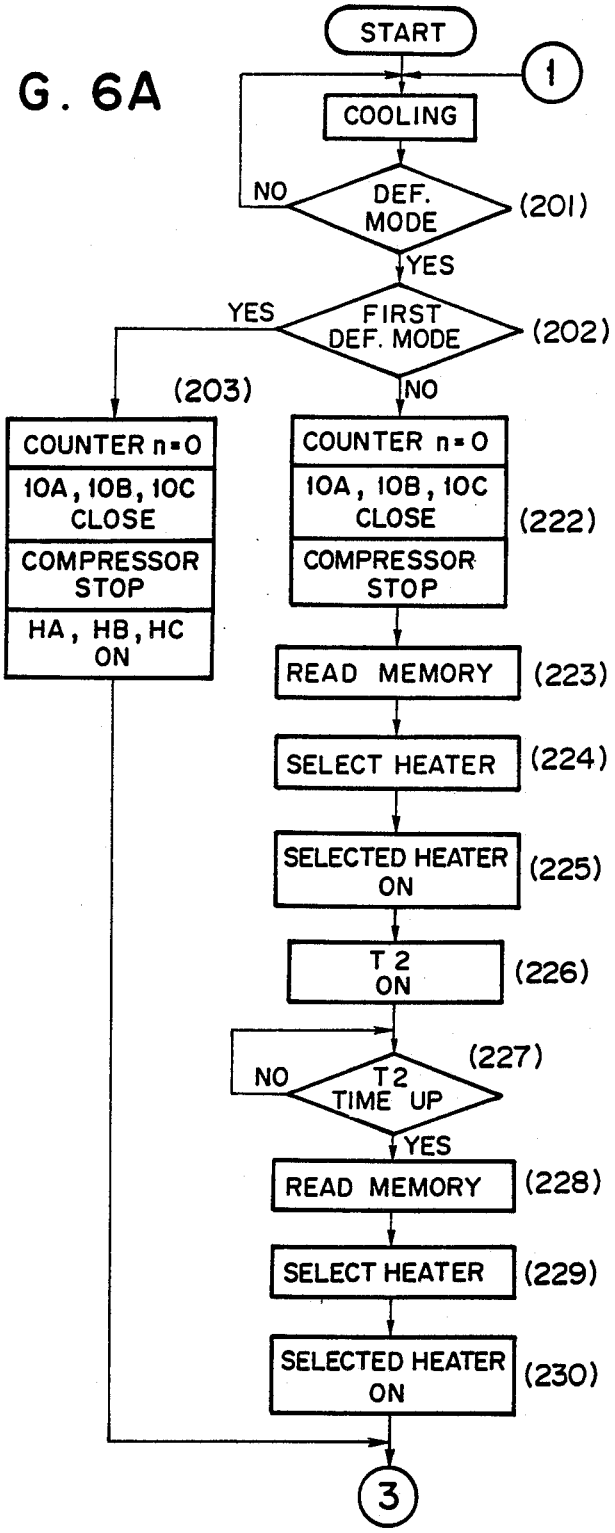
FIGS. 6A and 6B are flowcharts of a control unit assembled in the electric circuit of FIG. 5, showing details of a second defrosting method according to the present invention.
Figure 6B:
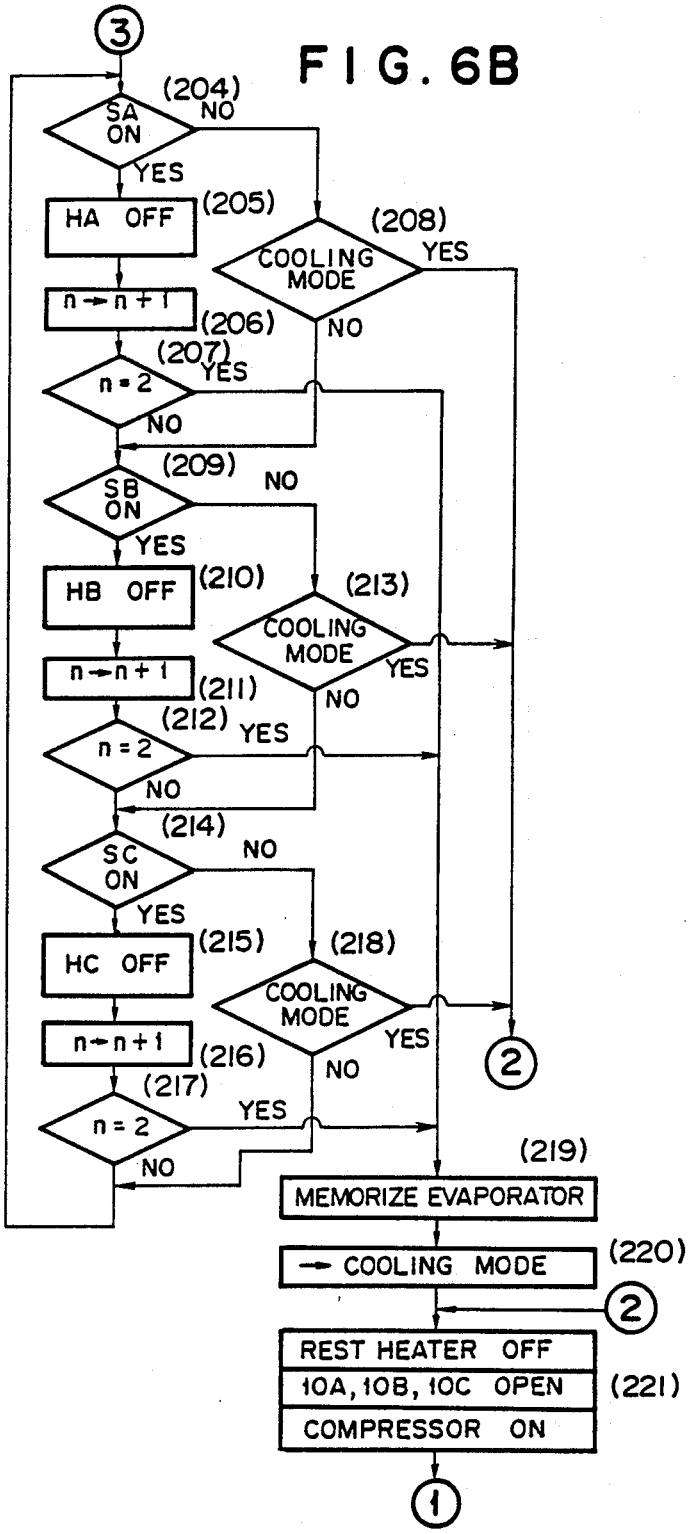
Figure 7:
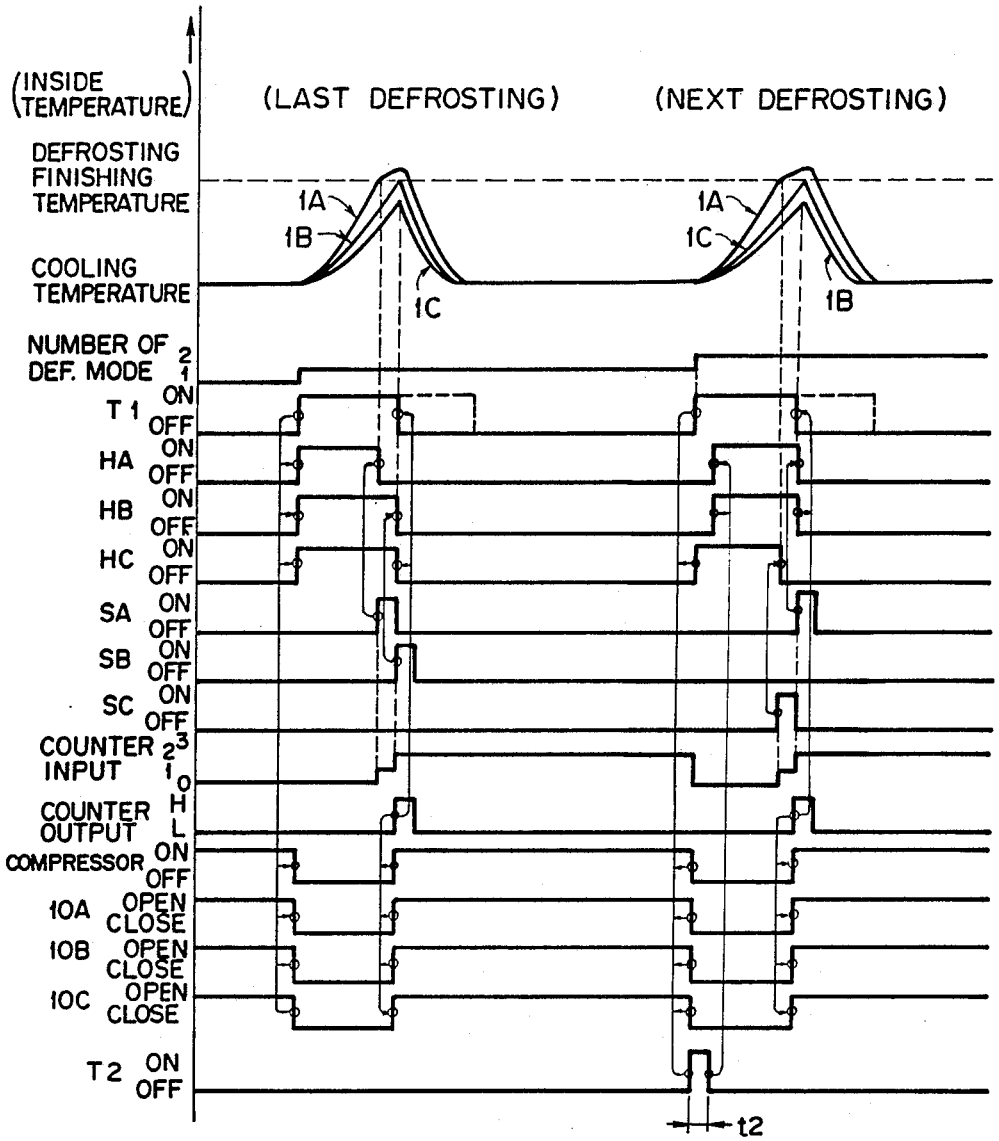
FIG. 7 is a time chart showing the timing of defrosting according to the method of FIGS. 6A and 6B.

FIGS. 6A and 6B show a flow chart for controlling the defrosting of the evaporators (5A, 5B and 5C) and FIG. 7 shows a time chart of the control.

The period of time between defrosting intervals and the period of time for defrosting are preset by a defrosting timer T1. The defrosting is performed when defrosting timer T1 switches to its defrosting mode, i.e. "on" position. It is first determined whether the defrosting timer has switched to the defrosting mode (step 201). If still in the cooling mode, flow returns to step 201.

At step 202, it is determined whether the current defrosting mode is the first defrosting mode. This is accomplished by regarding a flag in memory representative of the completion of a previous defrosting mode or by regarding a counter for counting defroshing modes. In the case of the current mode being the first defrosting mode, a counter for counting the number of defrosted units is reset, all of solenoid valves 10A, 10B and 10C are closed, the drive of compressor 8 is stopped and electric current is supplied to all of defrosting heaters HA, HB and HC (step 203).

Successively, it is determined whether sensor SA has detected the defrosting of evaporator 5A (step 204). When sensor SA has detected the defrosting of evaporator 5A, the supply of electric current to defrosting heater HA is stopped (step 205), 1 count is added to the counter (step 206), and it is determined whether the number of the counter is equal to a preset number (2 in this embodiment) (step 207). If sensor SA has not detected the defrosting of evaporator 5A, it is determined whether the current mode is the cooling mode (step 208). With respect to sensors SB and SC and defrosting heaters HB and HC, similar steps 209–218 are provided.

If the number stored in the counter is not 2 yet, at step 217, flow returns to step 204. When the current mode is determined to be the cooling mode in any of steps 208, 213 and 218, flow proceeds to step 221 as described later. When the number becomes 2 at step 207, 212 or 217, in this embodiment as shown in FIG. 7, as, for example, when sensors SA and SB detect the defrosting of evaporators 5A and 5B, the identity of defrosted evaporators, 5A and 5B are stored in memory (step 219).

Then, defrosting timer T1 is forcedly reset to the cooling mode (step 220), the supply of electric current to the remaining defrosting heater (or heaters), i.e. defrosting heater HC, is stopped, all of solenoid valves 10A, 10B and 10C are opened and the drive of compressor 8 is started (step 221). All of evaporators 5A, 5B and 5C cool respective units 1A, 1B and 1C. Flow returns to step 201. Referring to FIG.7, only units 1A and 1B are defrosted completely.

In the next defrosting mode, the current defrosting mode is determined to not be the first defrosting mode at step 202. At step 222, the counter of defrosting modes (or flag) is reset, all of solenoid valves 10A, 10B and 10C are closed and the drive of compressor 8 is stopped. Then, from memory, the prior defrosted states of evaporators 5A and 5B is read out (step 223). The remaining defrosting heater or heaters HC for the evaporator 5C which previously was not completely defrosted is selected by process of elimination (step 224). Electric current is supplied to the selected defrosting heater HC (step 225). At the same time, a delay timer T2 for presetting a delay time t2 starts (step 226). The time up of this delay timer T2 is determined at step 227. When the preset delay time t2 expires, the defrosted status of evaporators 5A and 5B is again read out (step 228), the defrosted evaporators 5A and 5B from the last defrosting mode are selected (step 229), and electric current is supplied to the selected evaporators 5A and 5B (step 230).

After that, in the same manner as in the aforementioned first defrosting mode, steps 203–218 are repeated. Thus, in this "next defrosting mode" of this second embodiment, evaporators 5C and 5A are defrosted and the identity of these evaporators are stored in memory for the next defrosting mode, according to FIG. 7.

Thus, the supply of electric current to defrosting heater HC for evaporator 5C, which was not completely defrosted in the "last defrosting" mode, begins earlier by the time t2 than the supply of current to defrosting heaters HA and HB for evaporators 5A and 5B which were completely defrosted in the "last defrosting" mode. Evaporator 5C is defrosted sooner and more strongly than evaporators 5A and 5B, and the frost on evaporator 5C including the frost remained from the last defrosting mode can be sufficiently dissolved and eliminated. As a result, the sufficient and uniform defrosting of all of the evaporators is obtained after the second "next defrosting" mode.

Figure 8:
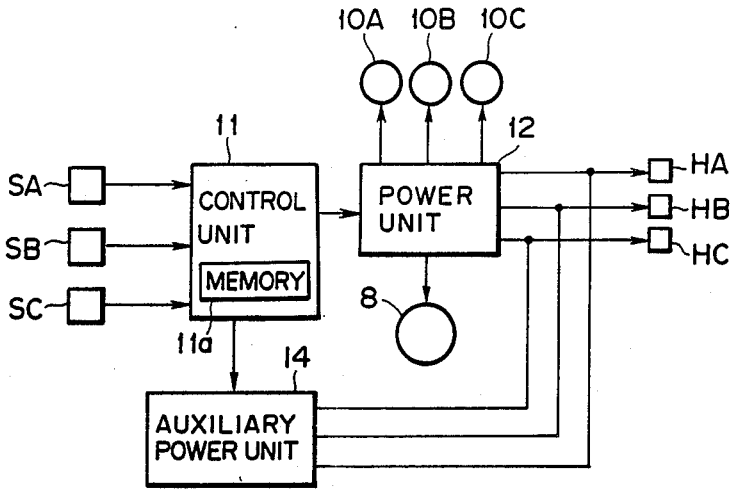
FIG. 8 is a diagram schematically illustrating an electric circuit of a cooling system used for a method according to a third embodiment of the present invention.
Figure 14:
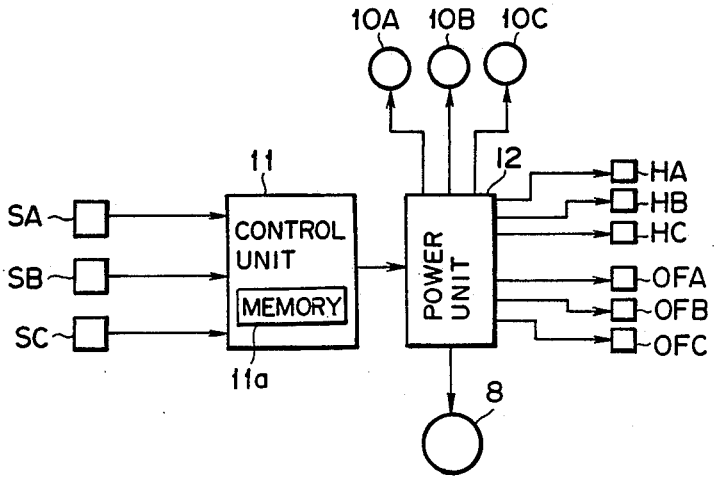
FIG. 14 is a diagram schematically illustrating an electric circuit of the cooling system of FIG. 13.

FIGS. 8, 9A, 9B and 10 show a third embodiment of the present invention. In this embodiment, an auxiliary power unit 14 for supplying electric current to defrosting heaters HA, HB and HC is provided together with the main power unit 12, as shown in FIG. 8. The arrangement and structure of the equipment other than the auxiliary power unit 14 and the control system programed in control unit 11 are substantially the same as in the first embodiment shown in FIG. 1.

Figure 9A:
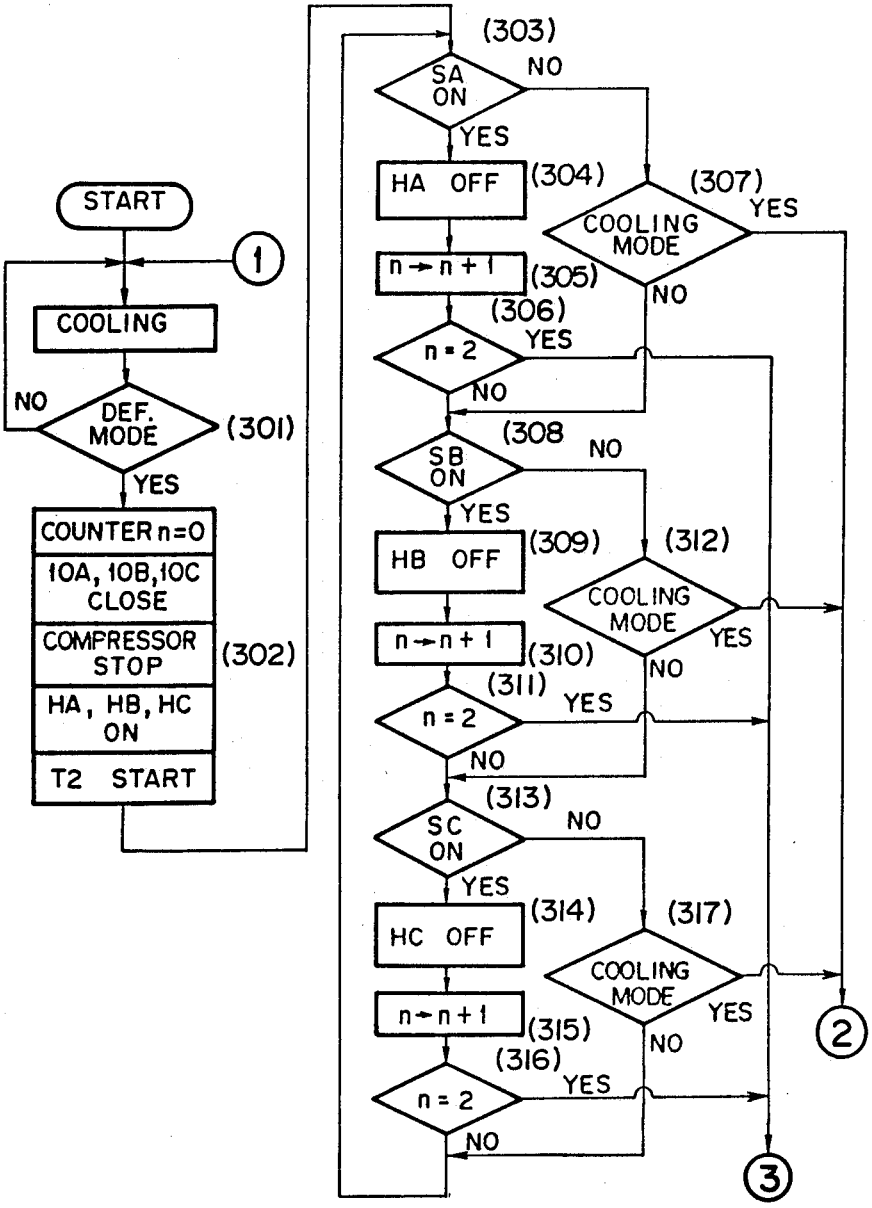
FIGS. 9A and 9B are flowcharts of a control unit assembled in the electric circuit of FIG. 8, showing details of a third defrosting method according to the present invention.
Figure 9B:
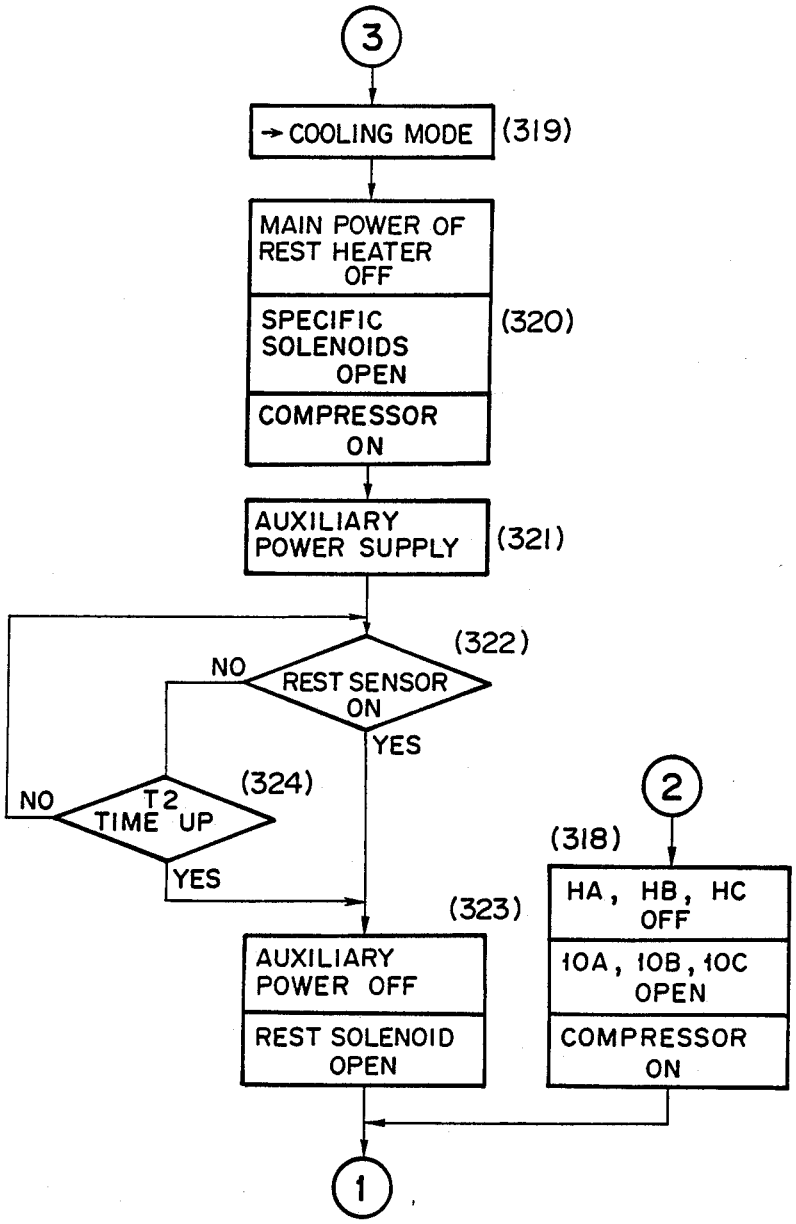
Figure 10:
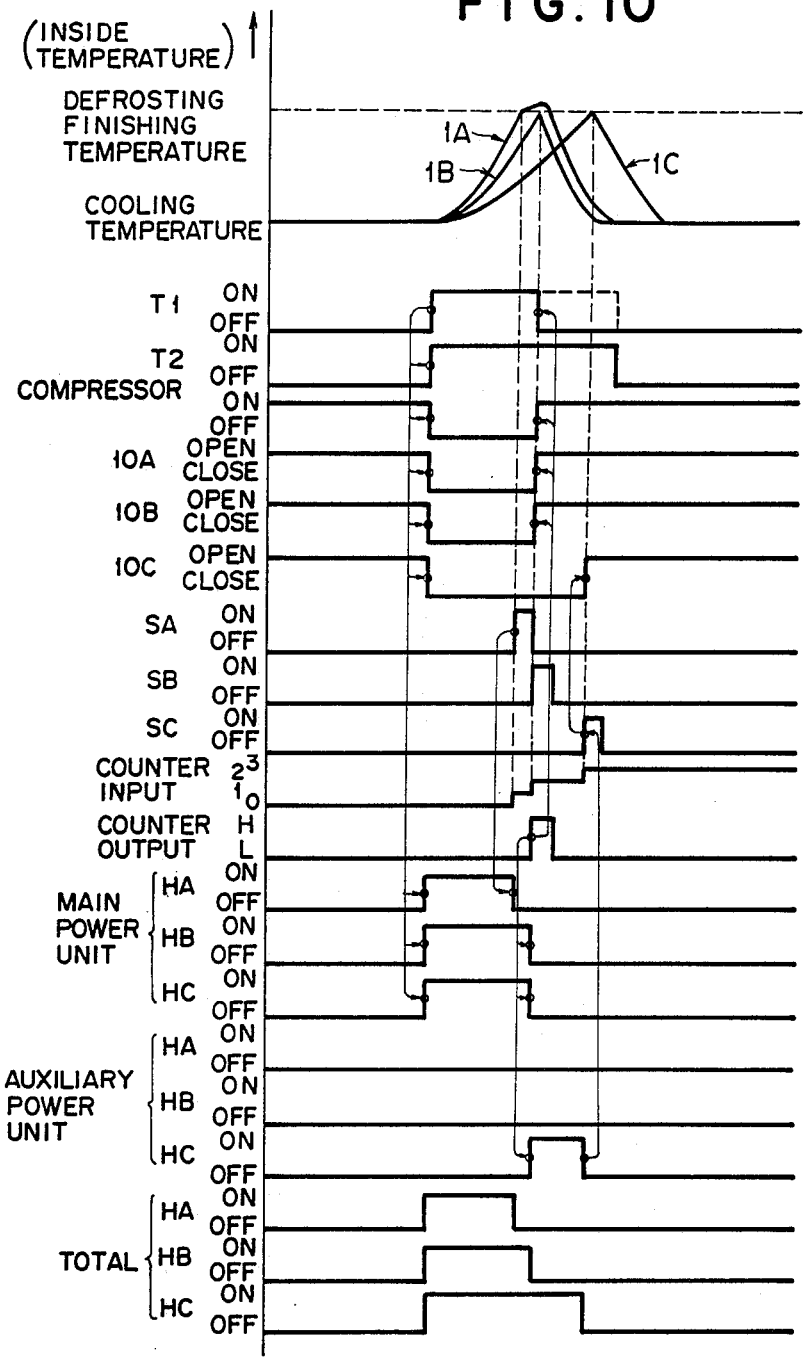
FIG. 10 is a time chart showing timing of a defrosting according to the third method.

FIGS. 9A and 9B show a flow chart for controlling the defrosting of the evaporators and FIG. 10 shows a time chart of the control method of this embodiment.

The time period between defrosting periods and the period of time for defrosting are preset by a defrosting timer T1. The defrosting is performed when defrosting timer T1 switches to its defrosting mode, i.e. "on" position. It is first determined during the cooling mode of defrosting timer T1 (T1 OFF) whether the defrosting timer has switched to the defrosting mode (T1 ON) (step 301). If the current mode is the cooling mode, flow returns to the starting point.

If the current mode is the defrosting mode, a counter for counting the number of units which have been defrosted is reset, all of solenoid valves 10A, 10B and 10C are closed, the drive of compressor 8 is stopped, electric current is supplied to all of defrosting heaters HA, HB and HC from main power unit 12, and timer T2 for checking the period of time of defrosting starts (step 302).

At step 303, it is determined whether sensor SA has detected the defrosting of evaporator 5A. When sensor SA detects the defrosting of evaporator 5A, the supply of electric current to defrosting heater HA is stopped (step 304), 1 count is added to the counter (step 305), and it is determined whether the number of the counter is equal to a preset number (2 in this embodiment) (step 306). If sensor SA has not detected the defrosting of evaporator 5A, it is determined whether the current mode is the cooling mode (step 307). With respect to sensors SB and SC and defrosting heaters HB and HC, similar steps 308–317 are provided.

If the number of defrosted units stored in the counter is less than 2 at step 316, flow returns to step 303. If the current mode is determined as the cooling mode at any of steps 307, 312 and 317, flow proceeds to step 318. At step 318, the supply of electric current from main power unit 12 to all of defrosting heaters HA, HB and HC is stopped, all of solenoid valves 10A, 10B and 10C are opened and the drive of compressor 8 is started. All of units 1A, 1B and 1C are cooled.

When the number of defrosted units stored in the counter equals 2 at step 306, 311 or 316, that is, in this embodiment as shown in FIG. 10 when sensors SA and SB detect the defrosting of evaporators 5A and 5B, defrosting timer T1 is forcedly reset to the cooling mode (step 319). The supply of electric current to the rest of the defrosting heaters, i.e. defrosting heater HC from main power unit 12 is stopped, only solenoid valves 10A and 10B, which are connected to defrosted evaporators 5A and 5B, are opened, and the drive of compressor 8 is started (step 320). The cooling medium is circulated through evaporators 5A and 5B, and the insides of units 1A and 1B are cooled. At the same time, electric current is supplied to the remaining defrosting heater (or heaters) HC from auxiliary power unit 14, thus the supply of electric current is continued (step 321).

Then it is determined whether sensor SC, which is the remaining sensor, has detected the defrosting of evaporator 5C (step 322). If sensor SC has detected the defrosting of evaporator 5C, solenoid valve 10C, which is the remaining solenoid valve, is opened (step 323), the cooling medium is circulated also through evaporator 5C and the inside of unit 1C is cooled. Flow returns to step 1. Even if sensor SC has not detected the defrosting of evaporator 5C, solenoid valve 10C is opened after a preset time from the beginning of the defrosting mode expires, namely, when timer T2 has timed out (step 324). If the preset time has not expired, flow returns to step 322.

Thus, the supply of electric current to defrosting heater HC for evaporator 5C which requires a longer time for defrosting is continued by auxiliary power unit 14, and the frost on evaporator 5C is sufficiently dissolved and eliminated. On the other hand, already defrosted evaporators 5A and 5B which require relatively short defrosting times can begin to be cooled again sooner than cooling begins again in unit 1C, and any excessive temperature increase inside of units 1A and 1B can be adequately prevented.

Although auxiliary power unit 14 is used in this embodiment, electric current may be supplied from main power unit 12 to the remaining defrosting heater (or heaters) for the evaporator (or evaporators) which are not completely defrosted.

Figure 11A:
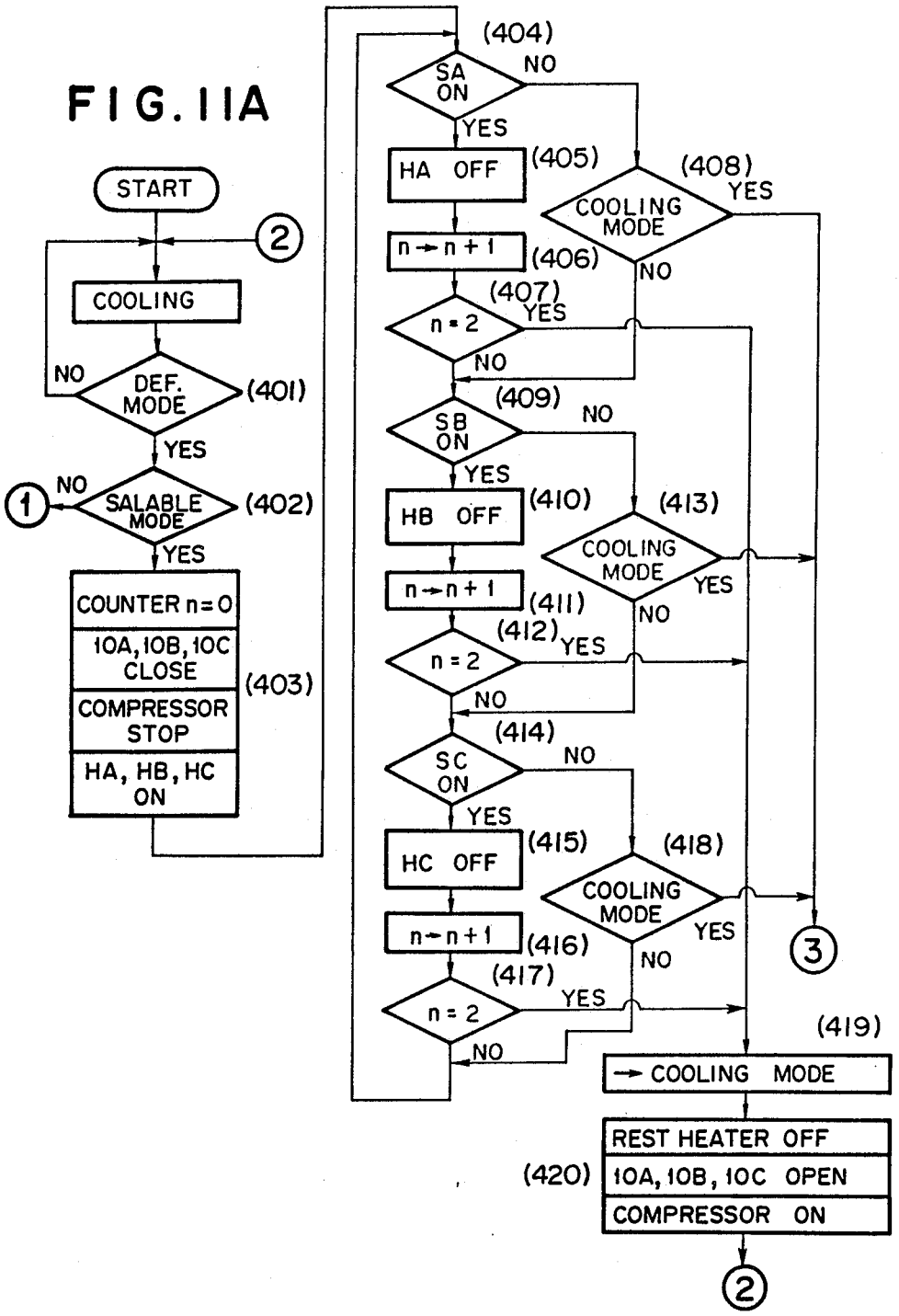
FIGS. 11A and 11B are flowcharts of a control unit in a cooling system used for a method according to a fourth embodiment of the present invention.
Figure 11B:
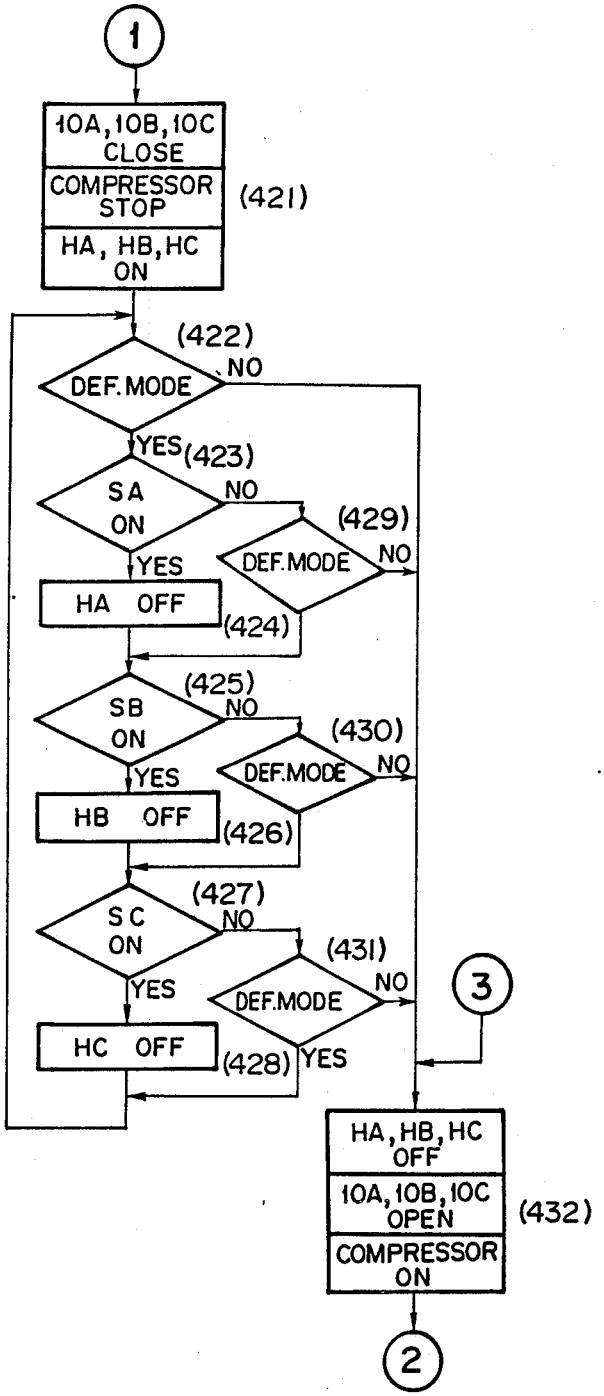
Figure 12:
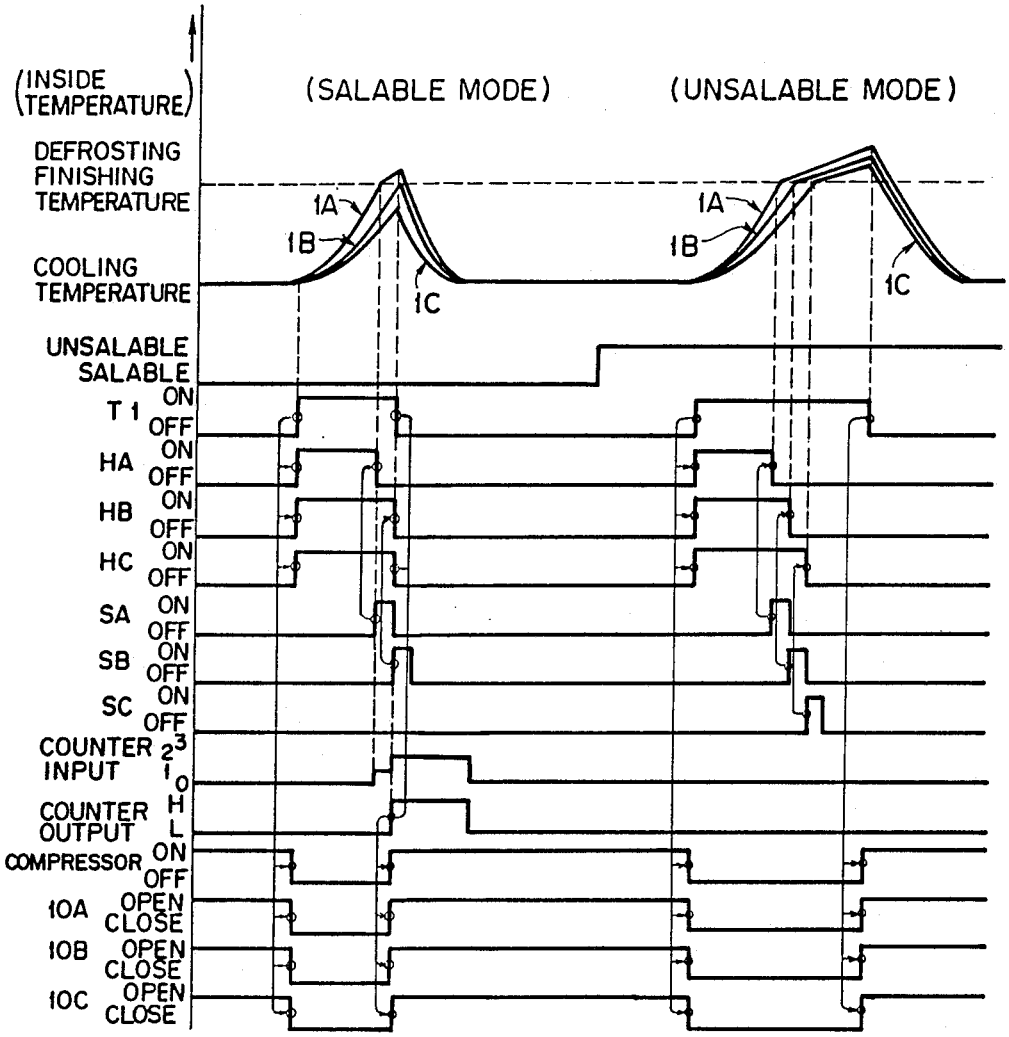
FIG. 12 is a time chart showing timing of a defrosting according to the fourth method.

FIGS. 11A, 11B and 12 show a fourth embodiment of the present invention. In this embodiment, the arrangement and structure of the equipment other than the control system programed in control unit 11 are substantially the same as in the first embodiment shown in FIG. 1. FIGS. 11A and 11B show a flow chart for controlling the defrosting of the evaporators and FIG. 12 shows a time chart of the control method according to this embodiment.

The time period between defrosting periods and the period of time for defrosting are preset by a defrosting timer T1. The defrosting is performed when defrosting timer T1 is switched to its defrosting mode, i.e. "on" position. It is first determined during the cooling mode whether the defrosting timer has switched to the defrosting mode (step 401). If the current mode is the cooling mode, flow returns to the starting point. If the current mode is the defrosting mode, it is determined whether the units are in the salable or unsalable mode or (step 402).

If the current mode is determined to be the salable mode at step 402, a counter for counting the number of defrosted units is reset, all of solenoid valves 10A, 10B and 10C are closed, the drive of compressor 8 is stopped, and electric current is supplied to all of defrosting heaters HA, HB and HC (step 403).

At step 404, it is determined whether sensor SA has detected the defrosting of evaporator 5A. If sensor SA has detected the defrosting of evaporator 5A, the supply of electric current to defrosting heater HA is stopped (step 405), 1 count is added to the counter (step 406), and it is determined whether the number stored in the counter is equal to a preset number (2 in this embodiment) (step 407). If sensor SA has not detected the defrosting of evaporator 5A, it is determined whether the current mode is the cooling mode (step 408). With respect to sensors SB and SC and defrosting heaters HB and HC, similar steps 409–418 are provided.

If the number stored in the counter is not yet equal to 2 at step 417, flow returns to step 404. If the current mode is determined as the cooling mode in any of steps 408, 413 and 418, flow proceeds to step 432 as described later. If the number stored in the counter is equal to 2 at step 407, 412 or 417, in this embodiment as shown in FIG. 12 after sensors SA and SB detect the defrosting of evaporators 5A and 5B, defrosting timer T1 is forcedly reset to the cooling mode (step 419). The supply of electric current to the rest of the defrosting heaters, i.e. defrosting heater HC, is stopped, all of solenoid valves 10A, 10B and 10C are opened and the drive of compressor 8 is started (step 420). The cooling medium is circulated through all of the evaporators, and the insides of all of units 1A, 1B and 1C are cooled. Flow returns to step 401. Defrosted evaporators 5A and 5B cool units 1A and 1B immediately after their defrosting, and the units can be efficiently cooled. Although a slight amount of frost may remain on evaporator 5C because its defrosting has not been completely finished, the frost can be completely eliminated during the unsalable mode, such as during night time.

In the case where the current mode is determined to be the unsalable mode at step 402 (FIG. 11A), all of the solenoid valves 10A 10B and 10C are closed, the drive of compressor 8 is stopped and electric current is supplied to all of defrosting heaters HA, HB and HC at step 421 (FIG. 11B).

Then, it is determined whether the current mode is the defrosting mode (step 422). If the current mode is the defrosting mode, it is determined whether sensor SA has detected the defrosting of evaporator 5A (step 423). If sensor SA has detected the defrosting of evaporator 5A, the supply of electric current to defrosting heater HA is stopped (step 424), and if the defrosting of evaporator 5A is not finished, it is determined whether the current mode is the defrosting mode (step 429). With respect to sensors SB and SC and defrosting heaters HB and HC, similar steps 425–431 are provided.

If the current mode is determined to be the cooling mode at any one of steps 422, 429, 430 and 431, the supply of electric current to all of defrosting heaters HA, HB and HC is stopped, all of solenoid valves 10A, 10B and 10C are opened and the drive of compressor 8 is begun (step 432). The cooling of all units starts. Flow returns to step 1.

Thus defrosting in the unsalable mode such as at night time is controlled. In the unsalable mode defrosting is continued until all of the evaporators are completely defrosted, and the frost on all of the evaporators is completely eliminated. Therefore, even if frost remains on any evaporator in the salable mode, the frost is completely dissolved and eliminated in the unsalable mode.

Figure 13:
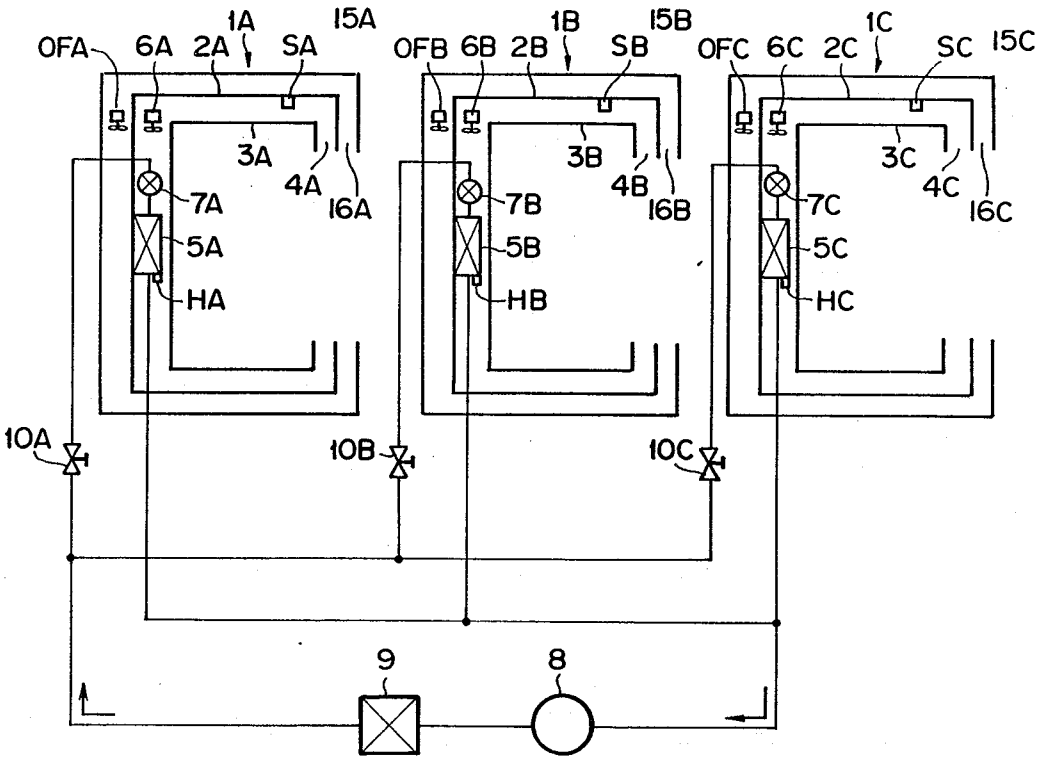
FIG. 13 is a schematic view illustrating a cooling system used for a method according to a fifth embodiment of the present invention.

FIGS. 13, 14, 15 and 16 show a fifth embodiment of the present invention. Referring to FIG.13, a further outer box 15A, 15B and 15C is provided for each unit and located outside of outer boxes 2A, 2B and 2C, and air paths 16A, 16B and 16C are formed between respective outer boxes 2A, 2B and 2C and respective other outer boxes 15A, 15B and 15C. Outer fans OFA, OFB and OFC are disposed in air paths 16A, 16B and 16C, respectively. Each outer fan can make an air flow curtain at the front of each unit and the air flow curtain can prevent outside air from entering into the showcase. When the drive of the outer fan is stopped, outside air can be led to the position of each of evaporators 5A, 5B and 5C through each of air paths 16A, 16B and 16C. Electric current is supplied to respective outer fans OFA, OFB and OFC from power unit 12. The arrangement and structure of the equipment other than the above and the control system programed in control unit 11 are substantially the same as in the first embodiment shown in FIG. 1.

Figure 15:
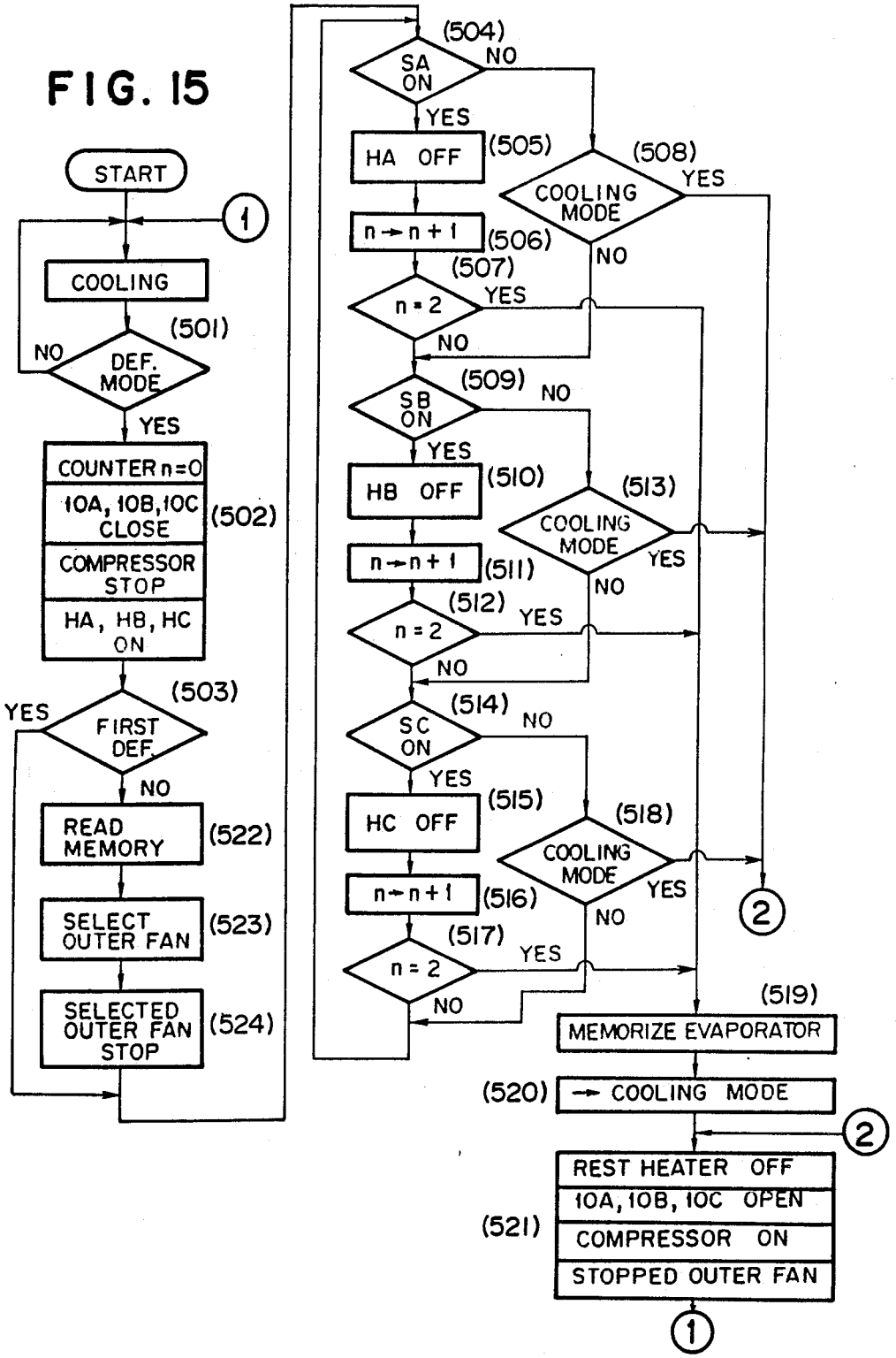
FIG. 15 is a flowchart of a control unit assembled in the electric circuit of FIG. 14, showing details of a fifth defrosting method according to the present invention.
Figure 16:
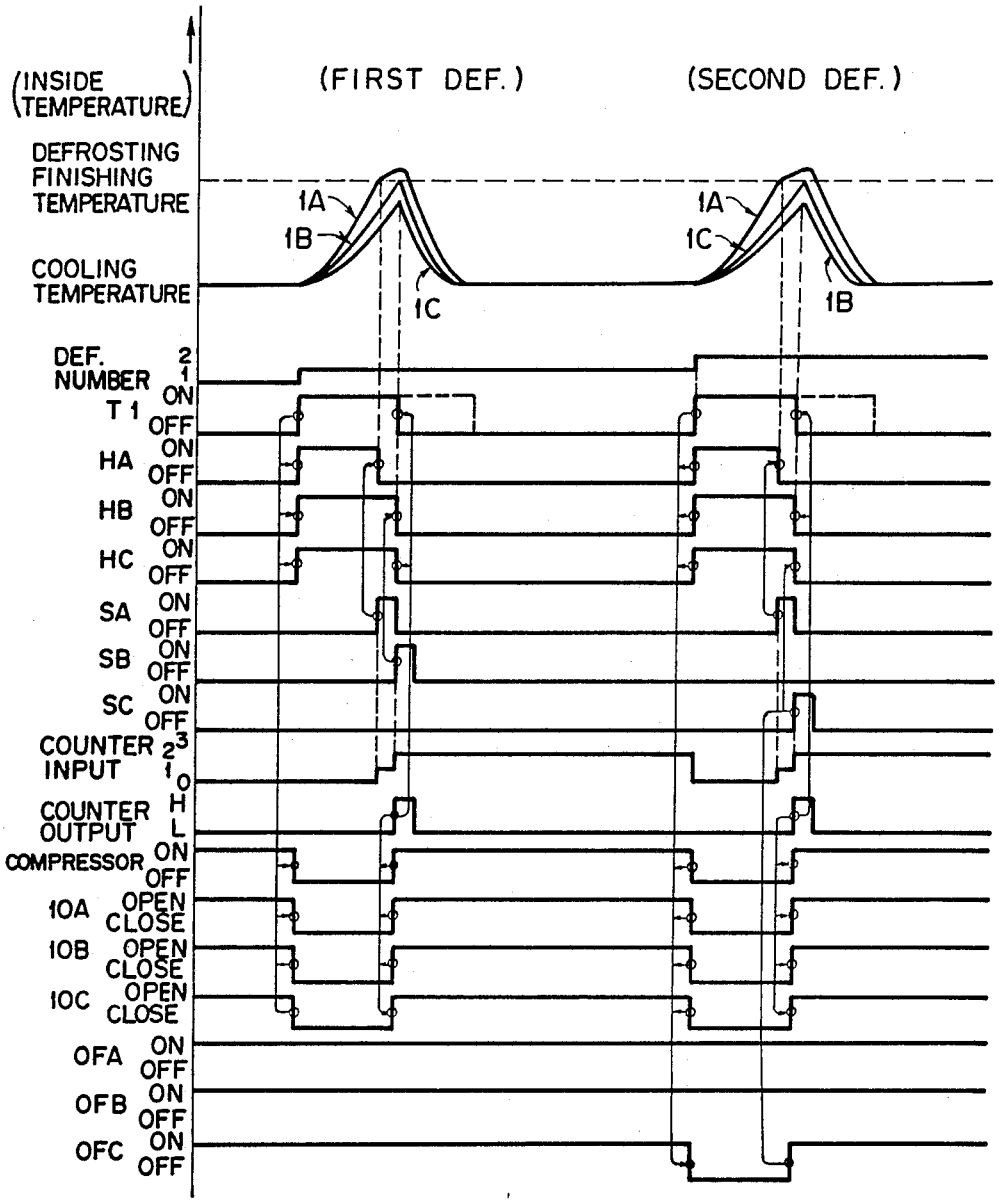
FIG. 16 is a time chart showing timing of a defrosting according to the fifth method.
Figure 17:
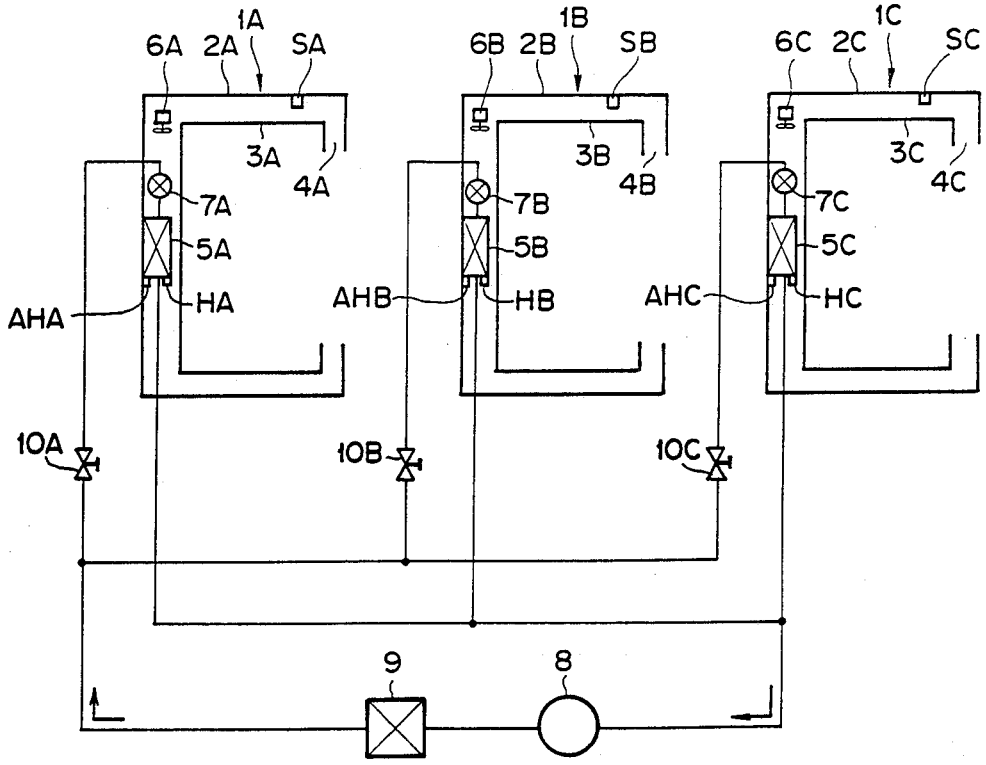
FIG. 17 is a schematic view illustrating a cooling system used for a method according to a sixth embodiment of the present invention.
Figure 18:
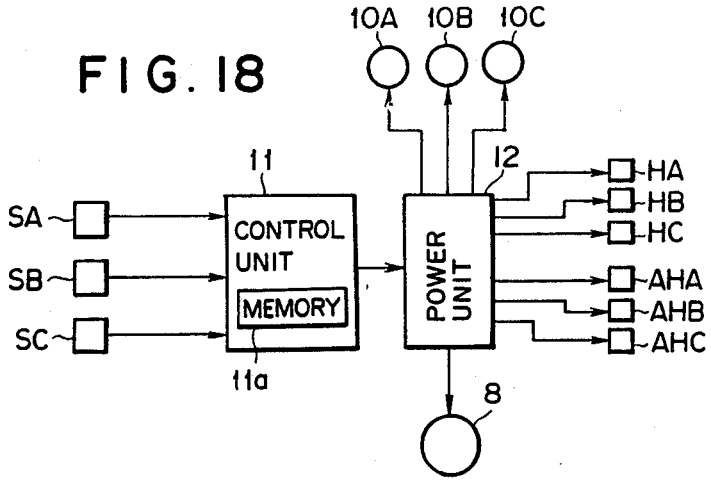
FIG. 18 is a diagram schematically illustrating an electric circuit of the cooling system of FIG. 17.

FIG. 15 shows a flow chart for controlling the defrosting of the evaporators and FIG. 16 shows a time chart of the control.

The time period between defrosting periods and the period of time for defrosting are preset by a defrosting timer T1. The defrosting is performed after defrosting timer T1 switches to its defrosting mode, i.e. "on" position. It is first determined during the cooling mode of defrosting timer T1 whether the defrosting timer has switched to the defrosting mode (step 501). If the current mode is still the cooling mode, flow returns to the starting point.

If the current mode is the defrosting mode, a counter for counting the number of defrosted units is reset, all of solenoid valves 10A, 10B and 10C are closed, the drive of compressor 8 is stopped, and electric current is supplied to all of defrosting heaters HA, HB and HC (step 502).

At step 503, it is determined whether the current defrosting mode is the first defrosting mode. If this defrosting mode is the first defrosting mode, it is determined whether sensor SA has detected the defrosting of evaporator 5A (step 504). If sensor SA has detected the defrosting of evaporator 5A, the supply of electric current to defrosting heater HA is stopped (step 505), 1 count is added to the counter (step 506), and it is determined whether the number stored in the defrosted unit counter is equal to a preset number (2 in this embodiment) (step 507). If sensor SA has not detected the defrosting of evaporator 5A, it is determined whether the current mode is the cooling mode (step 508). With respect to sensors SB and SC and defrosting heaters HB and HC, similar steps 509–518 are provided.

If the number stored in the counter is less than 2 at step 517, flow returns to step 504. If the current mode is determined to be the cooling mode in any of steps 508, 513 and 518, flow proceeds to step 521 as described later. If the number stored in the counter equals 2 in any of steps 507, 512 and 517, the identity of undefrosted evaporators are stored in memory (step 519). Then, the mode of the defrosting timer T1 is forcedly switched to the cooling mode (step 520). The supply of electric current to the rest of the defrosting heaters, i.e. defrosting heater HC is stopped, all of the solenoid valves 10A, 10B and 10C are opened, the drive of compressor 8 is started, and the drive of any stopped outer fans is started (step 521).

If the current mode is not determined to be the first defrosting mode at step 503, the identity of evaporators stored in memory from the last defrosting mode are read out (step 522). The outer fans corresponding to the read out evaporators are selected (step 523) and the drive of only the selected outer fans (outer fan OFC in this embodiment) is stopped (step 524). Then the flow proceeds to step 504.

In this second defrosting mode, since outer fan OFC, corresponding to evaporator 5C which has not completely defrosted after the first defrosting mode, stops, outside air is led to the position of evaporator 5C through air path 16C, and evaporator 5C is warmed more rapidly and strongly than other evaporators by the outside air temperature. Therefore, the frost on evaporator 5C including the frost from the last defrosting mode can be sufficiently dissolved and eliminated. In this embodiment, the inside temperatures of units 1A, 1B and 1C are controlled as shown in FIG. 16. The control after the third defrosting mode is performed similarly.

FIGS. 17, 18, 19 and 20 show a sixth embodiment of the present invention. In this embodiment, auxiliary defrosting heaters AHA, AHB and AHC are provided on evaporators 5A, 5B and 5C, respectively. Electric current is supplied to auxiliary defrosting heaters AHA, AHB and AHC from power unit 12. The arrangement and structure of the equipment other than the above and the control system programed in control unit 11 are substantially the same as in the first embodiment shown in FIG. 1.

Figure 19:
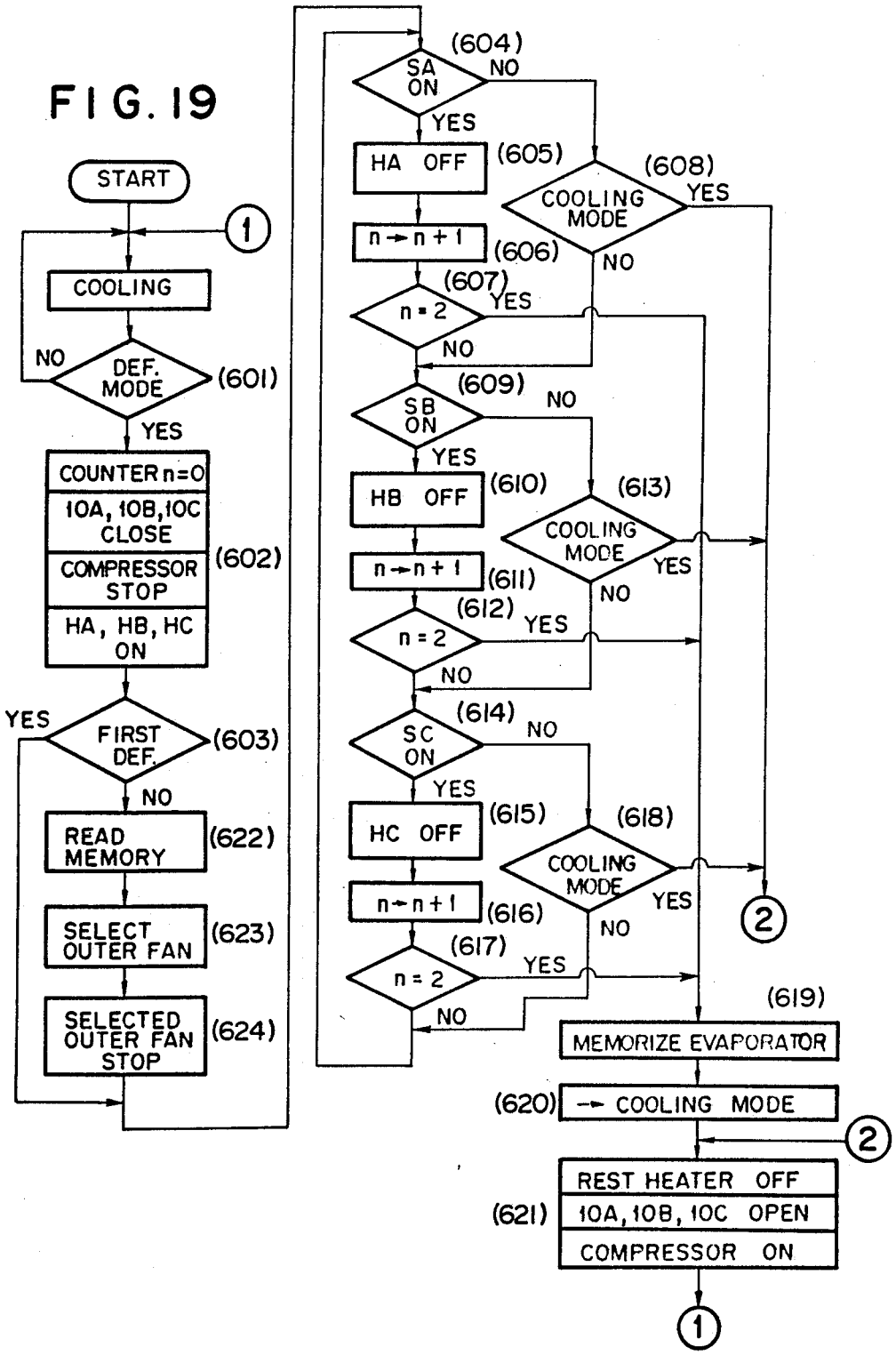
FIG. 19 is a flowchart of a control unit assembled in the electric circuit of FIG. 18, showing details of a sixth defrosting method according to the present invention.
Figure 20:
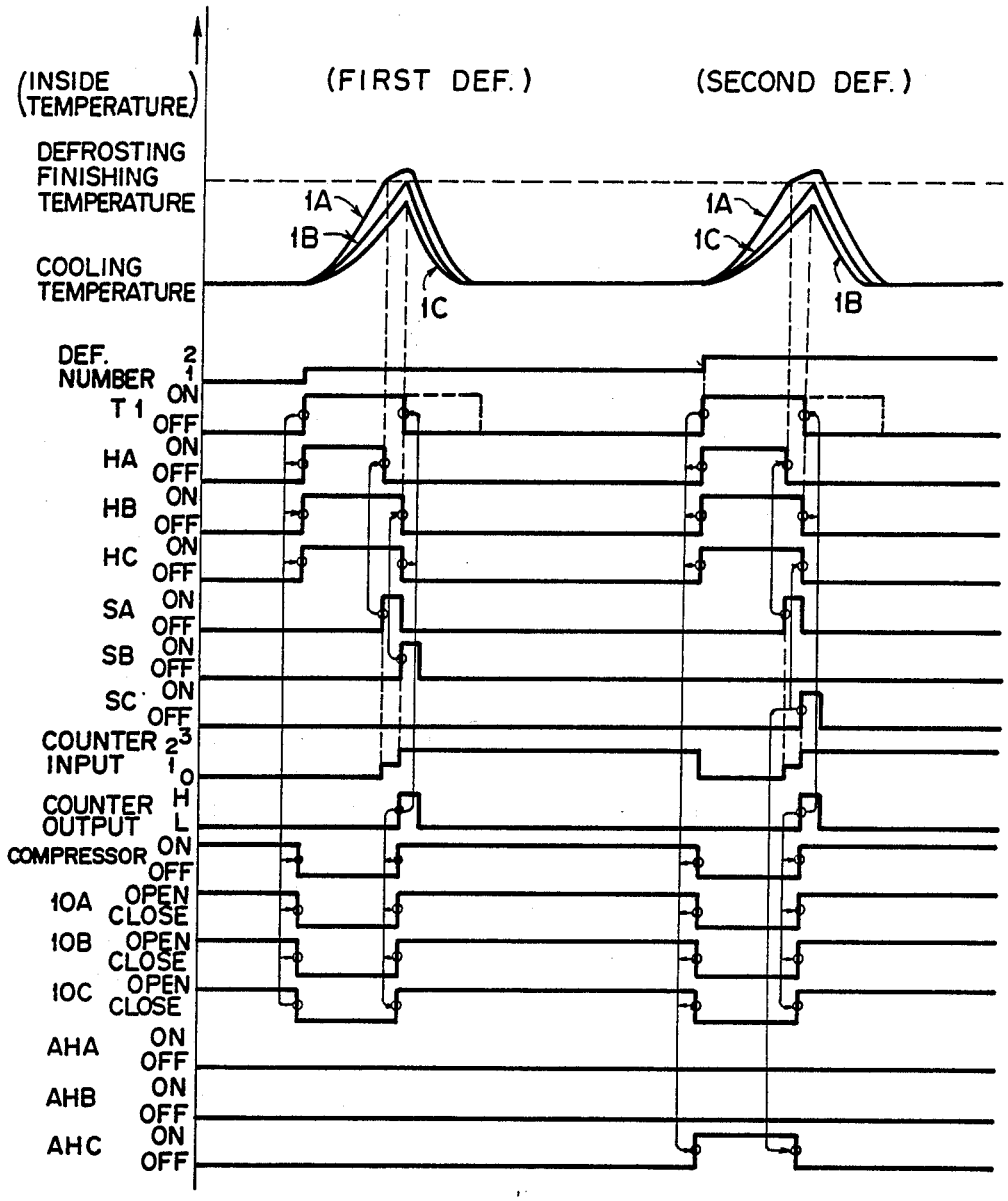
FIG. 20 is a time chart showing timing of a defrosting according to the sixth method.
Figure 21:
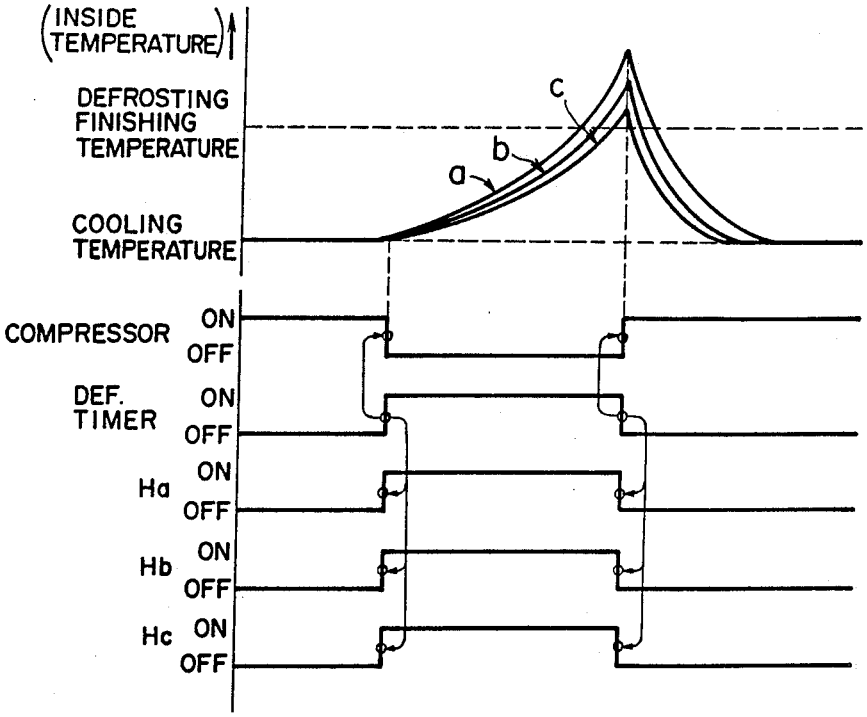
FIG. 21 PRIOR ART
FIG. 21 is a time chart showing the timing of a defrosting according to a conventional method.
Figure 22:
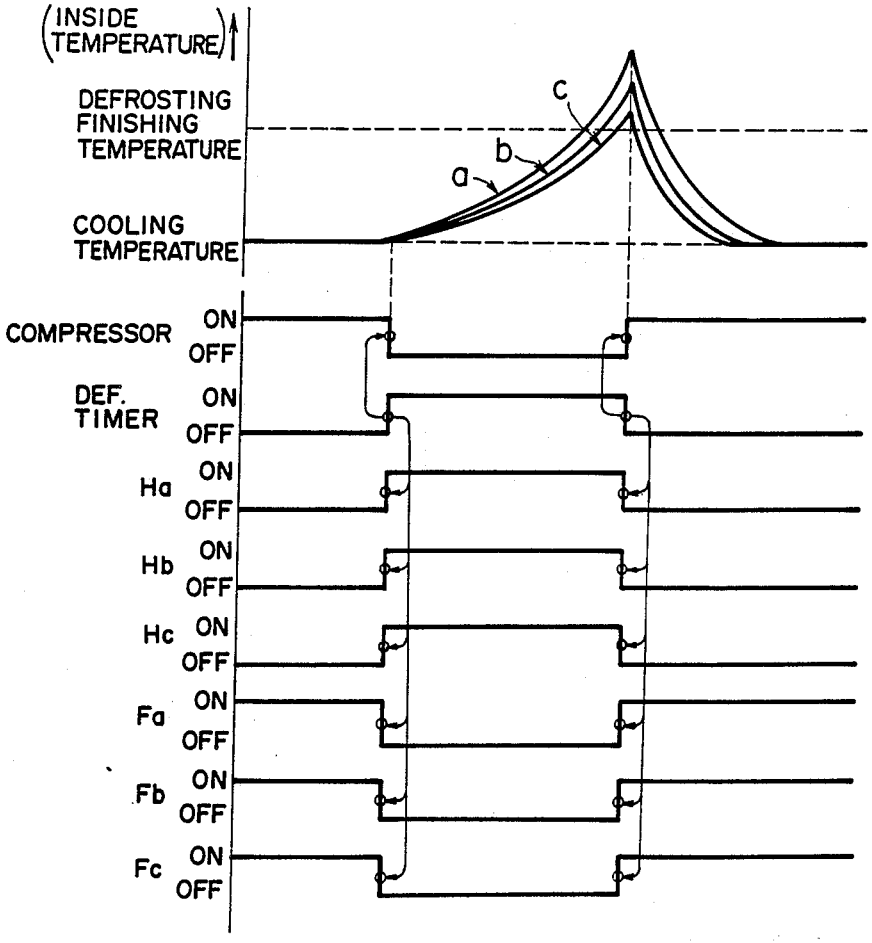
FIG. 22 PRIOR ART
FIG. 22 is a time chart showing timing of a defrosting according to another conventional method.

FIG. 19 shows a flow chart for controlling the defrosting of the evaporators and FIG. 20 shows a time chart of the control.

The time period between defrosting periods and the period of time for defrosting are preset by a defrosting timer T1. The defrosting is performed when defrosting timer T1 switches to its defrosting mode, i.e. "on" position. It is first determined during the cooling mode of defrosting timer T1 whether the defrosting timer has switched to the defrosting mode (step 601). If the current mode is the cooling mode, flow returns to the starting point.

If the current mode is the defrosting mode, a counter for counting the number of defrosted units is reset, all of solenoid valves 10A, 10B and 10C are closed, the drive of compressor 8 is stopped, and electric current is supplied to all of defrosting heaters HA, HB and HC (step 602).

At step 603, it is determined whether the current defrosting mode is the first defrosting mode. If the current defrosting mode is the first defrosting mode, it is determined whether sensor 5A has detected the defrosting of evaporator 5A (step 604). If sensor SA has detected the defrosting of evaporator 5A, the supply of electric current to defrosting heater HA and auxiliary defrosting heater AHA is stopped (step 605), 1 count is added to the counter (step 601), and it is determined whether the number stored in the counter is equal to a preset number (2 in this embodiment ) (step 607). If sensor SA has not detected the defrosting of evaporator 5A, it is determined whether the current mode is the cooling mode (step 608). With respect to sensors SB and SC, defrosting heaters HB and HC and auxiliary defrosting heaters AHB and AHC, similar steps 609–618 are provided.

If the number stored in the defrosted unit counter is not equal to 2 at step 617, flow returns to step 604. If the current mode is determined to be the cooling mode in any of steps 608, 613 and 618, flow proceeds to step 621 as described later. If the number stored in the counter equals 2 at any of steps 607, 612 and 617, identity of the undefrosted evaporators are stored in memory (step 619). Then, the defrosting mode of the defrosting timer T1 is forcedly switched to the cooling mode (step 620). The supply of electric current to the rest of the defrosting heaters and the rest of the auxiliary defrosting heaters, i.e. defrosting heater HC and auxiliary defrosting heater AHC, is stopped, all of solenoid valves 10A, 10B and 10C are opened and the drive of compressor 8 is started (step 621).

If the current mode is not determined to be the first defrosting mode at step 603, the evaporators stored in memory from the last defrosting mode are read out (step 622). The auxiliary defrosting heaters corresponding to the read out evaporators are selected (step 623) and the drive of only the selected auxiliary defrosting heaters (auxiliary defrosting heater AHC in this embodiment) is stopped (step 624). Then flow proceeds to step 604.

In this second defrosting mode, since auxiliary defrosting heater AHC, corresponding to undefrosted evaporator 5C from the first defrosting mode, is added for warming evaporator 5C, evaporator 5C is warmed more rapidly and strongly than other evaporators whose auxiliary defrosting heaters remain "off". Therefore, the frost on evaporator 5C including the frost remaining from the last defrosting mode can be sufficiently dissolved and eliminated. In this embodiment, the inside temperatures of units 1A, 1B and 1C are controlled as shown in FIG. 20. Control after the third defrosting mode is performed similarly.

Although the above-described systems comprise just three units in the above six embodiments, the number of units may be more than three. The principles described in the above six embodiments may be extended to systems of four or more units in accordance with the present invention.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of the invention as defined by the following claims.

What is claimed is:

1. A method for controlling the defrosting of a plurality of refrigerator-freezer units, the respective units having respective evaporators and respective defrosting heaters for defrosting frost accumulated on the evaporators, the respective evaporators being connected to a condenser and to a compressor via respective expansion valves and solenoid valves, comprising the steps of:

closing all of said solenoid valves, stopping the drive of said compressor and supplying electric current to all of said defrosting heaters after a defrosting timer having a cooling mode and a defrosting mode switches to its defrosting mode;

successively stopping the supply of electric current to a defrosting heater of said defrosting heaters after a corresponding sensor provided for each unit detects the defrosting of its corresponding evaporator;

forcedly resetting said defrosting timer to its cooling mode, stopping the supply of electric current to the rest of said defrosting heaters, beginning the drive of said compressor and opening the solenoid valves connected to defrosted evaporators after defrosting a preset number of evaporators among all of said evaporators; and opening the rest of said solenoid valves at least after a preset time expires since the beginning of said defrosting mode.

2. The method according to claim 1 further comprising the steps of switching said units between a salable mode and an unsalable mode, when said showcases are in said unsalable mode, successively stopping the supply of electric current to said defrosting heater of said defrosting heaters after said corresponding sensor detects the defrosting of its corresponding evaporator, beginning the drive of said compressor and opening all of said solenoid valves after the time of said defrosting mode set to a period of time sufficient for the defrosting of substantially all of said evaporators expires, whichever occurs first.

* * * * *